US009448507B2

(12) United States Patent
Suzuki

(10) Patent No.: US 9,448,507 B2
(45) Date of Patent: Sep. 20, 2016

(54) NOZZLE RECEIVER, POWDER CONTAINER, AND IMAGE FORMING APPARATUS

(71) Applicant: Michiharu Suzuki, Kanagawa (JP)

(72) Inventor: Michiharu Suzuki, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/832,181

(22) Filed: Aug. 21, 2015

(65) Prior Publication Data

US 2016/0070204 A1 Mar. 10, 2016

(30) Foreign Application Priority Data

Sep. 10, 2014 (JP) ..... 2014-184567
Feb. 13, 2015 (JP) ..... 2015-026838

(51) Int. Cl.
*G03G 15/08* (2006.01)

(52) U.S. Cl.
CPC ..... *G03G 15/0886* (2013.01)

(58) Field of Classification Search
CPC ..... G03G 15/0886; G03G 15/0837; G03G 15/0839
USPC ..... 399/258, 260, 262
See application file for complete search history.

(56) References Cited

U.S. PATENT DOCUMENTS

2013/0272750 A1 10/2013 Matsumoto et al.
2013/0330105 A1* 12/2013 Komatsu et al. ..... 399/262
2014/0241757 A1 8/2014 Kikuchi et al.
2014/0270859 A1 9/2014 Hosokawa et al.
2014/0348551 A1 11/2014 Yamabe et al.
2016/0004184 A1 1/2016 Kikuchi et al.

FOREIGN PATENT DOCUMENTS

JP 2012-133349 7/2012
JP 5516833 4/2014
JP 2014-157371 8/2014
JP 2014-164107 9/2014
JP 2016-14848 A 1/2016
WO WO 2014/142362 A1 9/2014
WO WO 2015/141861 A1 9/2015

OTHER PUBLICATIONS

U.S. Appl. No. 14/558,466, filed Dec. 2, 2014.

* cited by examiner

*Primary Examiner* — Hoang Ngo

(74) *Attorney, Agent, or Firm* — Oblon, McClelland, Maier & Neustadt, L.L.P.

(57) ABSTRACT

A nozzle receiver for use with a powder container includes: a shutter to open an opening of the nozzle receiver to an opening position when the shutter is pressed by a conveying nozzle of an image forming apparatus, and to close the opening to a closing position when not being pressed by the conveying nozzle, and that includes a sealing portion for sealing the opening; a supporter to support and guide the shutter between the opening position and the closing position; and a cap to cover the supporter when the shutter is located at the closing position.

20 Claims, 20 Drawing Sheets

NOZZLE RECEIVER, POWDER CONTAINER, AND IMAGE FORMING APPARATUS

CROSS-REFERENCE TO RELATED APPLICATIONS

The present application claims priority to and incorporates by reference the entire contents of Japanese Patent Application No. 2014-184567 filed in Japan on Sep. 10, 2014 and Japanese Patent Application No. 2015-26838 filed in Japan on Feb. 13, 2015.

BACKGROUND OF THE INVENTION

1. Field of the Invention

The present invention relates to a nozzle receiver, a powder container, and an image forming apparatus.

2. Description of the Related Art

In electrophotography image forming apparatuses, such as printers, facsimile machines, copiers, or multifunction peripherals with functions of a printer, a facsimile machine, and a copier, a powder conveying device supplies (replenishes) toner that is developer from a toner container serving as a powder container containing the developer that is powder to a developing device.

A toner container described in Japanese Patent Application Laid-open No. 2012-133349, includes a rotatable cylindrical powder storage, a nozzle receiver attached to the powder storage, an opening arranged on the nozzle receiver, and an opening/closing member that moves to a closing position at which the opening is closed and to an opening position at which the opening is opened along with insertion of the conveying nozzle of the powder replenishing device. When the opening/closing member is moved to the opening position by the conveying nozzle inserted in the toner container along with attachment of the toner container to the powder conveying device, the opening/closing member moves toner located near the opening.

In the configuration as described above, if there is no escape for toner that moves with the movement of the opening/closing member, the toner is compressed and cohered, and prevents the opening/closing member from moving to the closing position when the toner container is detached from the powder container, for example.

It is an object of the present invention to prevent toner from preventing an opening/closing member, which opens and closes an opening arranged on a nozzle receiver of a powder container, from moving to a closing position.

SUMMARY OF THE INVENTION

A nozzle receiver for use with a powder container includes: a shutter to open an opening of the nozzle receiver to an opening position when the shutter is pressed by a conveying nozzle of an image forming apparatus, and to close the opening to a closing position when not being pressed by the conveying nozzle, and that includes a sealing portion for sealing the opening; a supporter to support and guide the shutter between the opening position and the closing position; and a cap to cover the supporter when the shutter is located at the closing position.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

First Embodiment

Figure 1:
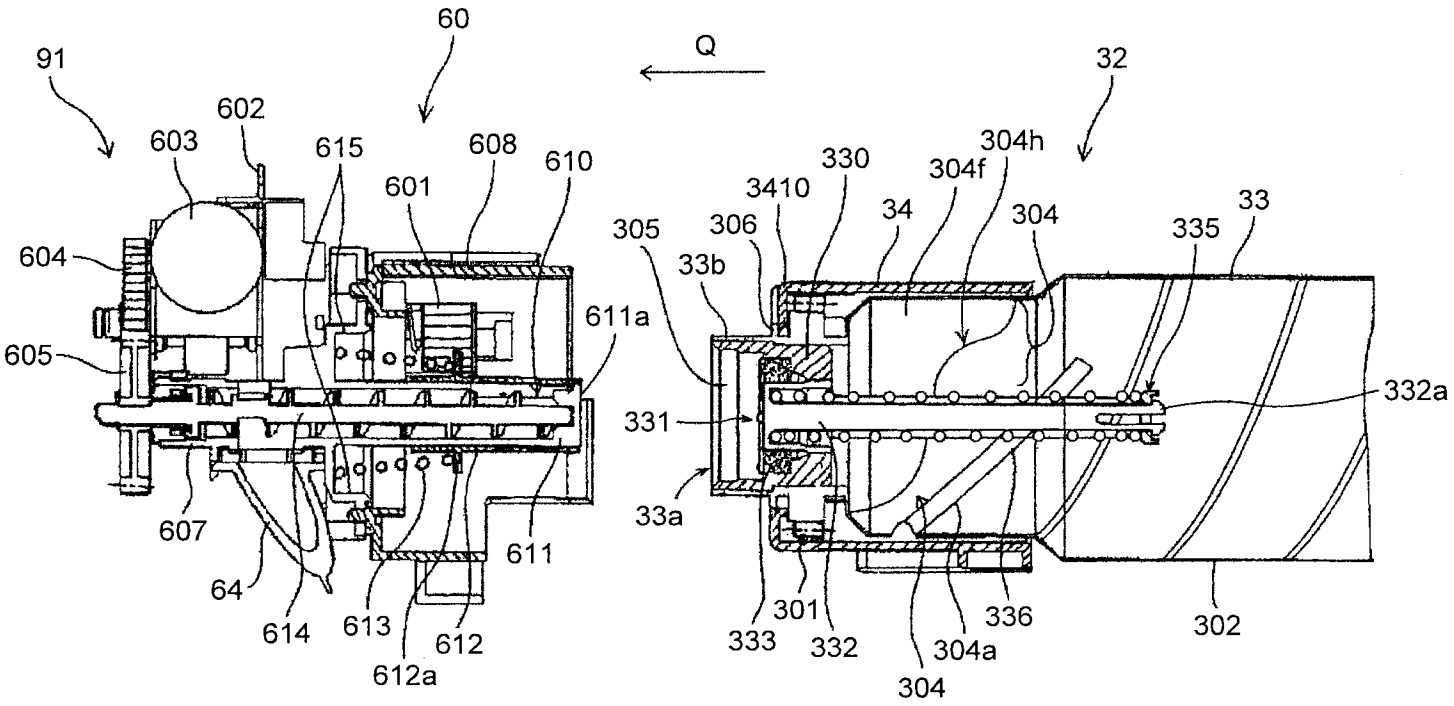
FIG. 1 is an explanatory cross-sectional view of a powder conveying device before a powder container according to embodiments of the present invention is attached and the powder container.

Embodiments of the present invention will be described below with reference to the accompanying drawings. In the descriptions of the embodiments and conventional configurations, the same components or components with the same functions are basically denoted by the same reference symbols, and detailed explanation thereof will be omitted. The descriptions below are mere examples and do not limit the scope of the appended claims. Further, a person skilled in the art may easily conceive other embodiments by making modifications or changes within the scope of the appended claims; however, such modifications and changes obviously fall within the scope of the appended claims. In the drawings, Y, M, C, and K are symbols appended to components corresponding to yellow, magenta, cyan, and black, respectively, and will be omitted appropriately.

Figure 2:
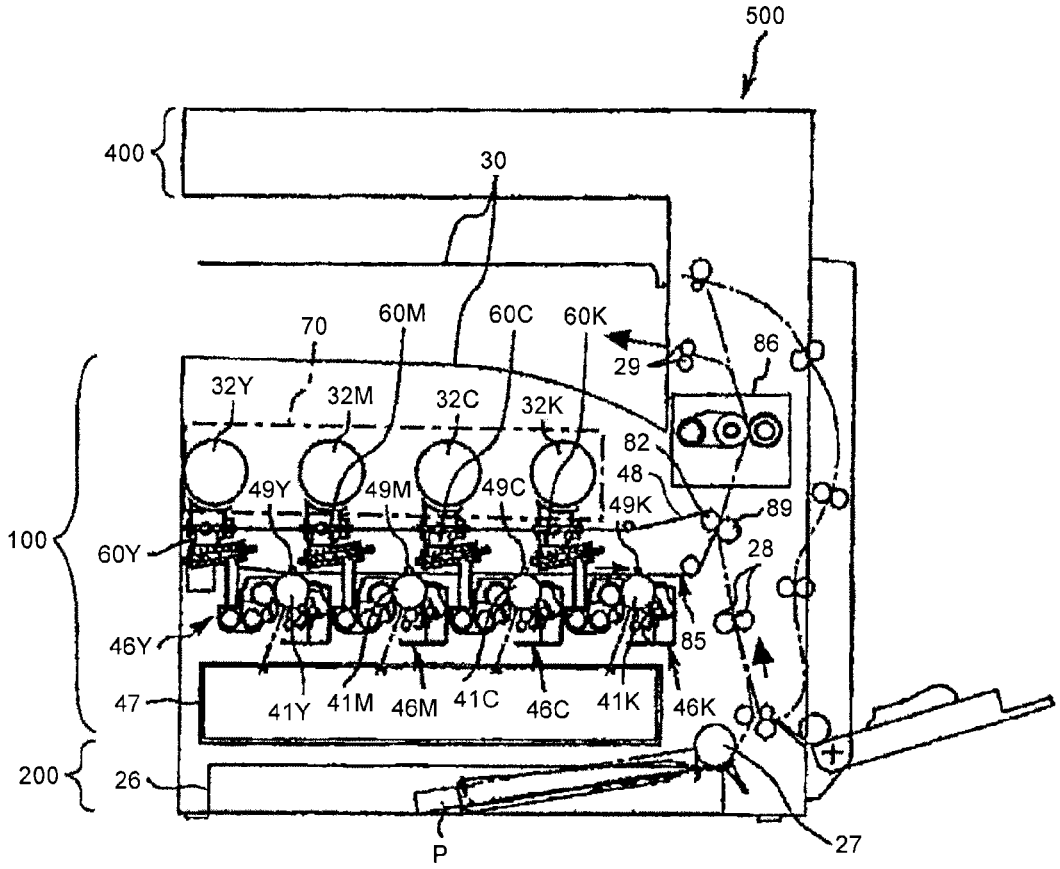
FIG. 2 is an overall configuration diagram of an image forming apparatus according to the embodiments.

FIG. 2 is an overall configuration diagram of an electrophotography tandem-type color copier (hereinafter, referred to as "a copier 500") serving as an image forming apparatus according to an embodiment. The copier 500 may be a monochrome copier. The image forming apparatus may be a printer, a facsimile machine, or a multifunction peripheral with at least two of the functions of a copier, a printer, a facsimile machine, and a scanner, instead of the copier. The copier 500 mainly includes a copier main-body (hereinafter, referred to as "a printer 100"), a sheet feed table (hereinafter, referred to as "a sheet feeder 200"), and a scanner section (hereinafter, referred to as "a scanner 400") mounted on the printer 100.

Four toner containers 32Y, 32M, 32C, 32K serving as powder containers corresponding to different colors (yellow, magenta, cyan, black) are detachably (replaceably) attached to a toner container holder 70 serving as a container holding section provided in the upper part of the printer 100.

An intermediate transfer device 85 is arranged below the toner container holder 70. The intermediate transfer device 85 includes an intermediate transfer belt 48 serving as an intermediate transfer medium, four primary-transfer bias rollers 49Y, 49M, 49C, 49K, a secondary-transfer backup roller 82, multiple rollers, an intermediate-transfer cleaning device, and the like. The intermediate transfer belt 48 is stretched and supported by multiple rollers and endlessly moves counterclockwise in FIG. 2 along with rotation of the secondary-transfer backup roller 82 serving as one of the rollers.

In the printer 100, four image forming sections 46Y, 46M, 46C, 46K corresponding to the respective colors are arranged in tandem so as to face the intermediate transfer belt 48. Four toner replenishing devices 60Y, 60M, 60C, 60K serving as powder replenishing (supply) devices corresponding to the four toner containers 32Y, 32M, 32C, 32K of the four colors are arranged below the toner containers 32Y, 32M, 32C, 32K, respectively. The toner replenishing devices 60Y, 60M, 60C, 60K respectively supply (replenish) toner T (see FIG. 3) that is powder developer contained in the toner containers 32Y, 32M, 32C, 32K to developing devices of the image forming sections 46Y, 46M, 460, 46K for the respective colors. In the embodiment, the four image forming sections 46Y, 46M, 46C, 46K form an image forming unit.

As illustrated in FIG. 2, the printer 100 includes an exposing device 47 serving as a latent-image forming means below the four image forming sections 46Y, 46M, 46C, 46K. The exposing device 47 exposes and scans the surfaces of photoconductors 41Y, 41M, 41C, 41K serving as image bearers (to be described later) with light based on image information of an original image read by the scanner 400, so that electrostatic latent images are formed on the surfaces of the photoconductors. The image information may be input from an external apparatus, such as a personal computer, connected to the copier 500, instead of being read by the scanner 400.

In the embodiment, a laser beam scanning system using a laser diode is employed as the exposing device 47. However, other configurations, such as a configuration including an LED array, may be employed as the exposing means.

Figure 3:
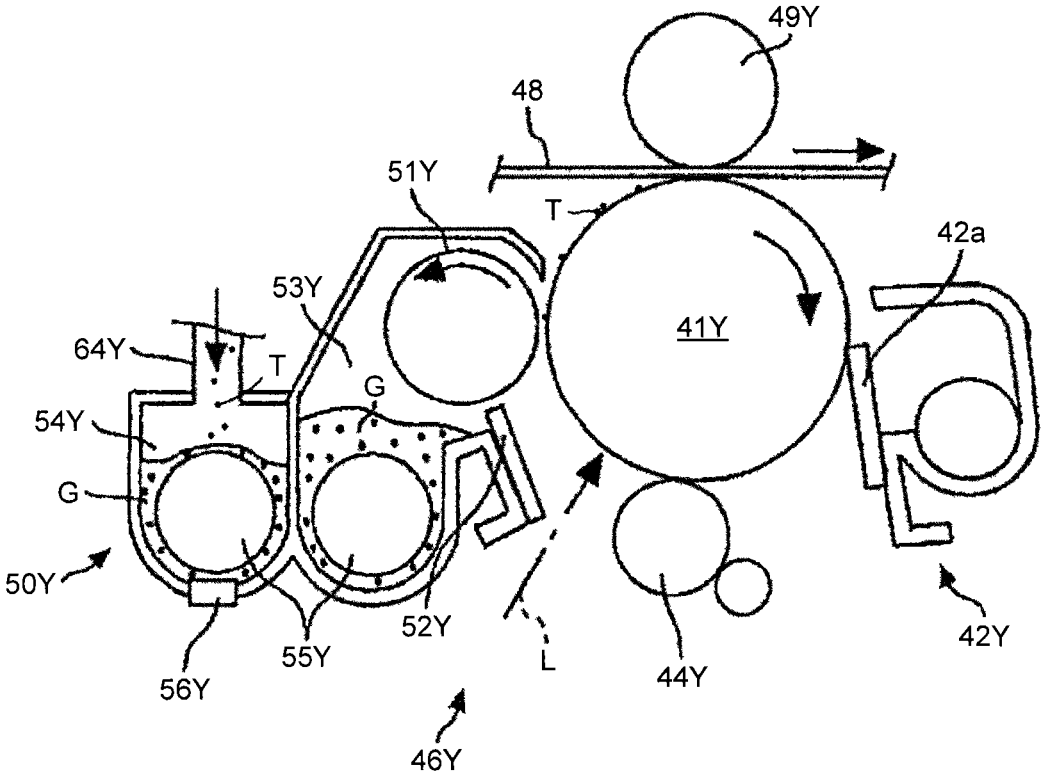
FIG. 3 is a schematic diagram illustrating a configuration of an image forming section of the image forming apparatus illustrated in FIG. 2.

FIG. 3 is a schematic diagram illustrating an overall configuration of the image forming section 46Y corresponding to yellow.

The image forming section 46Y includes the drum-shaped photoconductor 41Y. The image forming section 46Y includes a charging roller 44Y serving as a charging device, a developing device 50Y serving as a developing means, a cleaning device 42Y to clean the photoconductor, a neutralizing device, and the like, all of which are arranged around the photoconductor 41Y. Image forming processes (a charging process, an exposing process, a developing process, a transfer process, and a cleaning process) are performed on the photoconductor 41Y, so that a yellow toner image is formed on the photoconductor 41Y.

The other three image forming sections 46M, 46C, 46K have almost the same configurations as the image forming section 46Y for yellow except that colors of toner T to be used are different and toner images corresponding to the respective colors of the toner T are formed on the photoconductors 41M, 41C, 41K. Hereinafter, explanation of only the image forming section 46Y for yellow will be given, and explanation of the other three image forming sections 46M, 46C, 46K will be omitted appropriately.

The photoconductor 41Y is rotated clockwise in FIG. 3 by a driving motor. The surface of the photoconductor 41Y is uniformly charged at a position facing the charging roller 44Y (charging process). Subsequently, the surface of the photoconductor 41Y reaches a position of irradiation with laser light L emitted by the exposing device 47, where an electrostatic latent image for yellow is formed through exposure scanning (exposing process). The surface of the photoconductor 41Y then reaches a position facing the developing device 50Y, where the electrostatic latent image is developed with yellow toner T to form a yellow toner image (developing device).

The primary-transfer bias roller 49Y of the intermediate transfer device 85 and the photoconductor 41Y sandwich the intermediate transfer belt 48, so that a primary transfer nip for yellow is formed. A transfer bias with polarity opposite to the polarity of the toner T is applied to the primary-transfer bias roller 49Y.

The surface of the photoconductor 41Y, on which the toner image is formed through the developing process, reaches the primary transfer nip facing the primary-transfer bias roller 49Y across the intermediate transfer belt 48, and the toner image on the photoconductor 41Y is transferred to the intermediate transfer belt 48 at the primary transfer nip (primary transfer process). At this time, a slight amount of non-transferred toner remains on the photoconductor 41Y. The surface of the photoconductor 41Y, from which the toner image has been transferred to the intermediate transfer belt 48 at the primary transfer nip, reaches a position facing the cleaning device 42Y. At this position, the non-transferred toner remaining on the photoconductor 41Y is mechanically collected by a cleaning blade 42*a* included in the cleaning device 42Y (cleaning process). The surface of the photoconductor 41Y finally reaches a position facing the neutralizing device, where the residual potential on the photoconductor 41Y is removed. In this way, a series of the image forming processes performed on the photoconductor 41Y is completed.

The above-described image forming processes are also performed on the other image forming sections 46M, 46C, 46K in the same manner as the image forming section 46Y for yellow. Specifically, the exposing device 47 arranged below the image forming sections 46M, 46C, 46K emits laser light L based on the image information toward the photoconductors 41M, 41C, 41K of the image forming sections 46M, 46C, 46K. More specifically, the exposing device 47 emits the laser light L from a light source and irradiates each of the photoconductors 41M, 41C, 41K with the laser light L via multiple optical elements while performing scanning with the laser light L by a rotating polygon mirror.

Subsequently, toner images of the respective colors formed on the photoconductors 41M, 41C, 41K through the developing process are transferred to the intermediate transfer belt 48 due to the action of transfer biases applied to the respective primary-transfer bias rollers at the four-color primary-transfer nips that are formed by sandwiching the intermediate transfer belt 48 between the primary-transfer bias rollers 49M, 49C, 49K and the photoconductors 41M, 41C, 41K.

At this time, the intermediate transfer belt 48 moves counterclockwise in FIG. 2 and sequentially passes through the primary transfer nips of the primary-transfer bias rollers 49Y, 49M, 49C, 49K. Therefore, the toner images of the respective colors on the photoconductors 41Y, 41M, 41C, 41K are primarily transferred to the intermediate transfer belt 48 in a superimposed manner, so that a color toner image is formed on the intermediate transfer belt 48.

The intermediate transfer belt 48, on which the color toner image is formed by the superimposed toner images of the respective colors, reaches a position facing a secondary-transfer roller 89. At this position, the secondary-transfer backup roller 82 and the secondary transfer roller 89 sandwich the intermediate transfer belt 48, so that a secondary transfer nip is formed. The color toner image formed on the intermediate transfer belt 48 is transferred to a recording medium P, such as a sheet of paper, conveyed to the position of the secondary transfer nip, due to the action of a transfer bias applied to the secondary-transfer backup roller 82, for example. At this time, non-transferred toner which has not been transferred to the recording medium P remains on the intermediate transfer belt 48. The intermediate transfer belt 48 that has passed through the secondary transfer nip reaches the position of the intermediate-transfer cleaning device, where the non-transferred toner remaining on the surface is collected. In this way, a series of transfer processes performed on the intermediate transfer belt 48 is completed.

Movement of the recording medium P will be explained below with reference to FIG. 2.

The recording medium P is conveyed to the secondary transfer nip from a feed tray 26 provided in the sheet feeder 200 arranged below the printer 100 via a feed roller 27, a registration roller pair 28, and the like. Specifically, multiple recording media P are stacked in the feed tray 26. When the feed roller 27 is rotated counterclockwise in FIG. 2, the topmost recording medium P is fed to a nip between two rollers of the registration roller pair 28.

The recording medium P conveyed to the registration roller pair 28 temporarily stops at the position of the nip between the rollers of the registration roller pair 28, the rotation of which is being stopped. The registration roller pair 28 is rotated to convey the recording medium P toward the secondary transfer nip in accordance with the timing at which the color toner image on the intermediate transfer belt 48 reaches the secondary transfer nip. Accordingly, a desired color image is formed on the recording medium P.

The recording medium P on which the color toner image is transferred at the secondary transfer nip is conveyed to the position of a fixing device 86. In the fixing device 86, the color toner image transferred on the surface of the recording medium P is fixed to the recording medium P by heat and pressure applied by a fixing belt and a pressing roller. The recording medium P that has passed through the fixing device 86 is discharged to the outside of the apparatus via a nip between rollers of a discharge roller pair 29. The recording medium P discharged to the outside of the apparatus by the discharge roller pair 29 is sequentially stacked, as an output image, on a stack section 30. In this way, a series of image forming processes in the copier 500 is completed.

A configuration and operation of the developing device 50 in the image forming section 46 will be explained in detail below. In the following, the image forming section 46Y for yellow will be explained by way of example. However, the image forming sections 46M, 46C, 46K for the other colors have the same configurations and perform the same operation.

As illustrated in FIG. 3, the developing device 50Y includes a developing roller 51Y serving as a developer bearer, a doctor blade 52Y serving as a developer regulating plate, two developer conveying screws 55Y, a toner density sensor 56Y, and the like. The developing roller 51Y faces the photoconductor 41Y. The doctor blade 52Y faces the developing roller 51Y. The two developer conveying screws 55Y are arranged inside two developer accommodating sections, i.e., first and second developer accommodating sections 53Y and 54Y. The developing roller 51Y includes a magnet roller disposed inside thereof, a sleeve that rotates around the magnet roller, and the like. Two-component developer G containing carrier and toner is stored in the first developer accommodating section 53Y and the second developer accommodating section 54Y. The second developer accommodating section 54Y communicates with a toner dropping passage 64Y via an opening provided in the upper side thereof. The toner density sensor 56Y detects a toner density in the developer G stored in the second developer accommodating section 54Y.

The developer G in the developing device 50 circulates between the first developer accommodating section 53Y and the second developer accommodating section 54Y while being stirred by the two developer conveying screws 55Y. The developer G in the first developer accommodating section 53Y is supplied to and borne on the surface of the sleeve of the developing roller 51Y due to a magnetic field generated by the magnet roller in the developing roller 51Y while the developer G is being conveyed by one of the developer conveying screws 55Y. The sleeve of the developing roller 51Y rotates counterclockwise as indicated by an arrow in FIG. 3, and the developer G borne on the developing roller 51Y moves on the developing roller 51Y along with the rotation of the sleeve. At this time, the toner in the developer G electrostatically adheres to the carrier by being charged to the potential opposite to the polarity of the carrier due to triboelectric charging with the carrier in the developer G, and is borne on the developing roller 51Y together with the carrier that is attracted by the magnetic field generated on the developing roller 51Y.

The developer G borne on the developing roller 51Y is conveyed in the direction of the arrow in FIG. 3 and reaches a doctor section where the doctor blade 52Y and the developing roller 51Y face each other. The amount of the developer G on the developing roller 51Y is regulated and adjusted to an appropriate amount when the developer G passes through the doctor section, and then the developer G is conveyed to a development area facing the photoconductor 41Y. In the development area, the toner in the developer G adheres to the latent image formed on the photoconductor 41Y by a developing electric field generated between the developing roller 51Y and the photoconductor 41Y. The developer G remaining on the surface of the developing roller 51Y that has passed through the development area reaches the upper side of the first developer accommodating section 53Y along with the rotation of the sleeve. At this position, the developer G is separated from the developing roller 51Y.

The developer G in the developing device 50Y is adjusted so that the toner density falls within a predetermined range. Specifically, toner T contained in the toner container 32Y is replenished to the second developer accommodating section 54Y by the toner replenishing device 60Y (to be described later) through the toner dropping passage 64Y in accordance with the consumption of toner T of the developer G in the developing device 50Y through the development. The toner T replenished to the second developer accommodating section 54Y circulates between the first developer accommodating section 53Y and the second developer accommodating section 54Y while being mixed and stirred with the developer G by the two developer conveying screws 55Y.

Next, the toner replenishing devices 60Y, 60M, 60C, 60K will be described.

Figure 4:
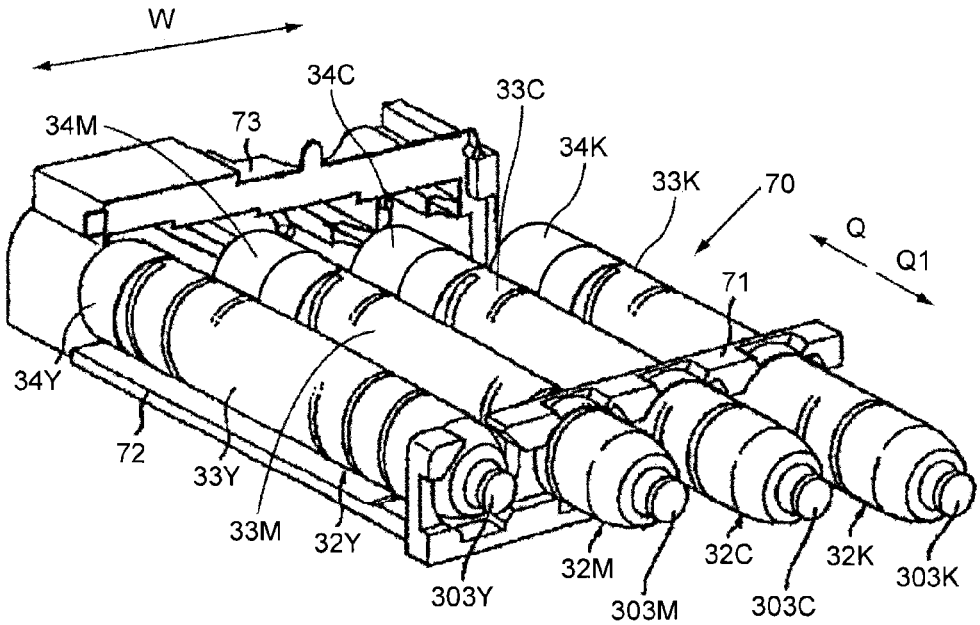
FIG. 4 is a schematic perspective view illustrating a state in which the powder containers are attached to a container holding section.
Figure 5:
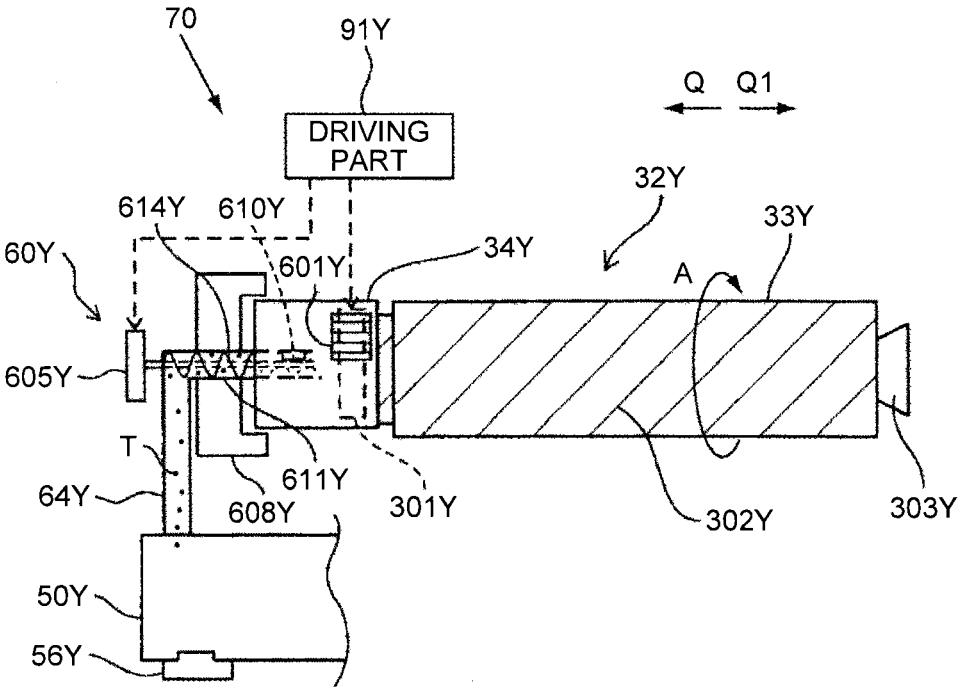
FIG. 5 is a schematic diagram illustrating a state in which the powder container is attached to the powder conveying device of the image forming apparatus illustrated in FIG. 2.

FIG. 4 is a schematic perspective view illustrating a state in which the four toner containers 32Y, 32M, 32C, 32K are attached to the toner container holder 70. FIG. 5 is a schematic diagram illustrating a state in which the toner container 32Y is attached to the toner replenishing device 60Y. The toner replenishing devices 60Y, 60M, 60C, 60K for the respective colors have the same configurations except that the colors of toner are different. Therefore, in FIG. 5, explanation of only the toner replenishing device 60Y and the toner container 32Y for yellow will be given, and explanation of the toner replenishing devices 60M, 60C, 60K and the toner containers 32M, 32C, 32K for the other three colors will be omitted appropriately. When the configurations vary depending on the colors, a symbol Y, M, C, or K representing a specific color is used. When the configurations do not vary depending on the colors or common to all of the colors, a symbol Y, M, C, or K may be used or all of the symbols may be omitted appropriately. In FIG. 4, an arrow Q indicates an attachment direction in which the toner containers 32 of the respective colors are attached to the toner replenishing devices 60, and Q1 indicates a detachment direction in which the toner containers 32 of the respective colors are detached from the toner replenishing devices 60.

The yellow toner T contained in the toner container 32Y among the toner containers 32Y, 32M, 32C, 32K for the respective colors attached to the toner container holder 70 of the printer 100 illustrated in FIG. 4 is appropriately replenished to the developing device in accordance with the consumption of toner in the developing device 50 as illustrated in FIG. 5. At this time, the toner in the toner container 32Y is replenished by the toner replenishing device 60Y. The toner replenishing device 60Y includes the toner container holder 70, a conveying nozzle 611Y serving as a nozzle, a conveying screw 614Y serving as a main body conveyor, the toner dropping passage 64Y, a driving part 91Y serving as a container rotating part, and the like.

The toner replenishing devices for the other colors have the same configurations. When a user performs attachment operation to push the toner container 32Y in the attachment direction Q in FIG. 5 and the toner container 32Y is moved inside the toner container holder 70 of the printer 100 along with the attachment direction Q, the conveying nozzle 611Y of the toner replenishing device 60Y is inserted from a front side of the toner container 32Y in the attachment operation Q. Therefore, the toner container 32Y and the conveying nozzle 611Y communicate with each other. A configuration for the communication along with the attachment operation will be described in detail later.

The toner container 32Y may be referred to as a toner bottle. The toner container 32Y mainly includes a container cover 34Y serving as a container front end cover or a held portion that is non-rotatably held by the toner container holder 70, and includes an approximately cylindrical container body 33Y serving as a powder storage integrated with a container gear 301Y serving as a container-side gear. The container body 33Y is rotatably held by the container cover 34Y. In FIG. 5, a setting cover 608Y is a part of a container cover receiving section 73 of the toner container holder 70.

As illustrated in FIG. 4, the toner container holder 70 mainly includes the container cover receiving section 73, a container receiving section 72, and an insertion hole part 71. The container cover receiving section 73 is a section for holding the container covers 34Y, 34M, 34C, 34K and the container bodies 33Y, 33M, 33C, 33K of the toner containers 32Y, 32M, 32C, 32K for the respective colors. The container receiving section 72 is a section for supporting the container bodies 33Y, 33M, 33C, 33K of the toner containers 32Y, 32M, 32C, 32K. An insertion hole 71*a* serving as an insertion opening used in the attachment operation of the toner containers 32Y, 32M, 32C, 32K is defined by the insertion hole part 71. When a main-body cover arranged on the front side of the copier 500 (the front side in the direction normal to the sheet of FIG. 2) is opened, the insertion hole part 71 of the toner container holder 70 is exposed. Then, attachment/detachment operation of the toner containers 32Y, 32M, 32C, 32K (attachment/detachment operation with the longitudinal direction of the toner containers 32 taken as an attachment/detachment direction) is performed from the front side of the copier 500 while the toner containers 32Y, 32M, 32C, 32K are oriented with their longitudinal directions being parallel to the horizontal direction.

The container receiving section 72 is provided such that its longitudinal length becomes approximately the same as the longitudinal lengths of the container bodies 33Y, 33M, 33C, 33K of the respective colors. The container cover receiving section 73 is arranged on a container front side (a side in the attachment direction Q) of the container receiving section 72 in the longitudinal direction (attachment/detachment direction), and the insertion hole part 71 is arranged on one end side (a side in the detachment direction Q1) of the container receiving section 72 in the longitudinal direction. The four toner containers 32Y, 32M, 32C, 32K are able to move on the container receiving section 72 in a sliding manner. Therefore, along with the attachment operation of the toner containers, the container covers 34Y, 34M, 34C, 34K first pass through the insertion hole part 71, slides on the container receiving section 72 for a while, and are finally attached to the container cover receiving section 73.

As illustrated in FIG. 5, a rotation driving force is input to the container gear 301Y serving as a gear provided on the container body 33Y, while the container cover 34Y is attached to the container cover receiving section 73. Specifically, the driving part (container rotating part) 91Y including a driving motor, a driving gear, and the like inputs a rotation driving force to the container gear 301Y via a container driving gear 601Y serving as an apparatus main-body gear. Therefore, the container body 33Y is rotated in the arrow A direction in FIG. 5. With the rotation of the container body 33Y, a spiral rib 302Y has a spiral shape on the inner surface of the container body 33Y conveys toner in the container body 33Y from one end on the right side in FIG. 5 to the other end on the left side in FIG. 5 along the longitudinal direction of the container body.

Namely, in the embodiment, the spiral rib 302Y serves as a rotary conveyor. Consequently, the toner is supplied to the inside of the conveying nozzle 611Y via a nozzle hole 610Y serving as a powder receiving hole provided on the conveying nozzle 611Y, and supplied from the other side of the toner container 32Y where the container cover 34Y is attached. The nozzle hole 610Y communicates with an opening 335*b*, which serves as a shutter side opening of a container shutter supporter (to be described later), at an inner position relative to the position where the container gear 301Y is arranged in the longitudinal direction of the container body 33Y. Specifically, the container gear 301Y meshes with the container driving gear 601Y on a container opening 33*a* side in the longitudinal direction of the toner container, relative to the position where the nozzle hole 610 and the opening 335*b* of the container shutter supporter communicate with each other.

The conveying screw 614Y is arranged in the conveying nozzle 611Y. When the driving part (container rotating part) 91Y inputs the rotation drive to a conveying screw gear 605Y, the conveying screw 614Y rotates to convey the toner T supplied in the conveying nozzle 611Y. A downstream end of the conveying nozzle 611Y in the conveying direction is connected to the toner dropping passage 64Y. The toner T conveyed by the conveying screw 614Y falls along the toner dropping passage 64Y by gravity and is replenished to the developing device 50Y (the second developer accommodating section 54Y).

The toner containers 32Y, 32M, 32C, 32K are replaced with new ones at the end of their lifetimes (when the containers become empty because almost all of the stored toner T is consumed). Grippers 303Y, 303M, 303C, 303K are arranged on one ends of the toner containers 32Y, 32M, 32C, 32K opposite to the container covers 34Y, 34M, 34C, 34K in the longitudinal direction in FIG. 4, that is, on the detachment direction Q1 sides. When the toner containers are to be replaced, an operator can grip the grippers 303Y, 303M, 303C, 303K to pull out and detach the toner containers 32Y, 32M, 32C, 32K attached to the toner container holder 70.

Figure 6:
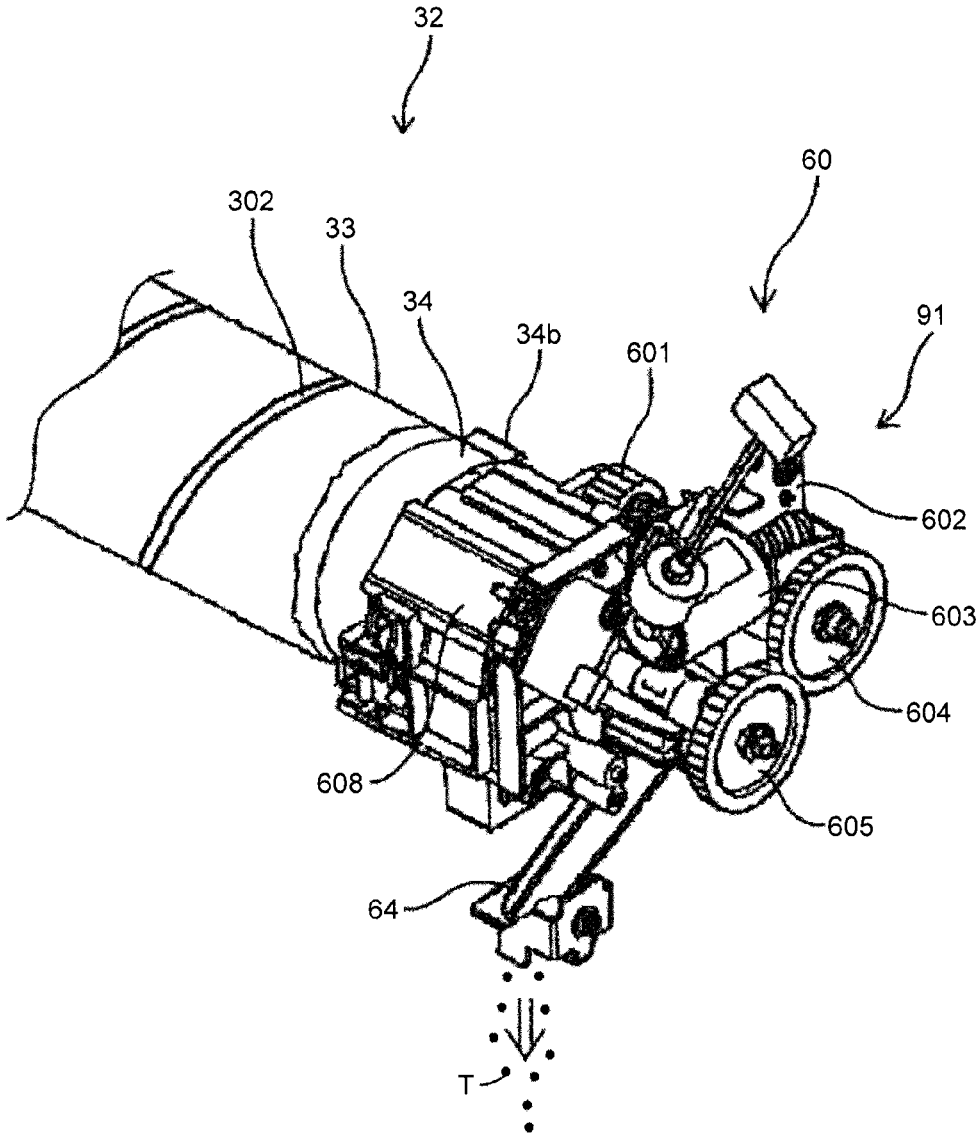
FIG. 6 is an explanatory perspective view of the powder conveying device to which the powder container is attached and the powder container.

The configuration of the driving part 91 will be further described below with reference to FIG. 6. In FIG. 6, symbols representing the colors are omitted. The driving part 91 includes the container driving gear 601 and the conveying screw gear 605. When a driving motor 603 fixed to a mounting frame 602 is driven and an output gear is rotated, the container driving gear 601 rotates. The conveying screw gear 605 rotates by receiving the rotation of the output gear via a coupled gear 604.

As illustrated in FIG. 4, the toner replenishing device 60Y controls the amount of toner supplied to the developing device 50Y in accordance with the rotation frequency of the conveying screw 614Y. Therefore, toner that passes through the conveying nozzle 611Y is directly conveyed to the developing device 50Y through the toner dropping passage 64Y without the need to control the amount of toner supplied to the developing device 50Y. Even in the toner replenishing device 60Y configured to insert the conveying nozzle 611Y into the toner container 32Y as described in the embodiment, it may be possible to arrange a temporary toner storage, such as a toner hopper. In the toner replenishing devices 60M, 60C, 60K for the other colors, the supply amount of toner is controlled in the same manner as in the toner replenishing device 60Y.

The toner containers 32Y, 32M, 32C, 32K and the toner replenishing devices 60Y, 60M, 60C, 60K according to the embodiment will be described in detail below. As described above, the toner containers 32Y, 32M, 32C, 32K and the toner replenishing devices 60Y, 60M, 60C, 60K have almost the same configurations except that the colors of toner to be used are different. Therefore, in the following descriptions, symbols Y, M, C, and K representing the colors of toner will be omitted.

Figure 7:
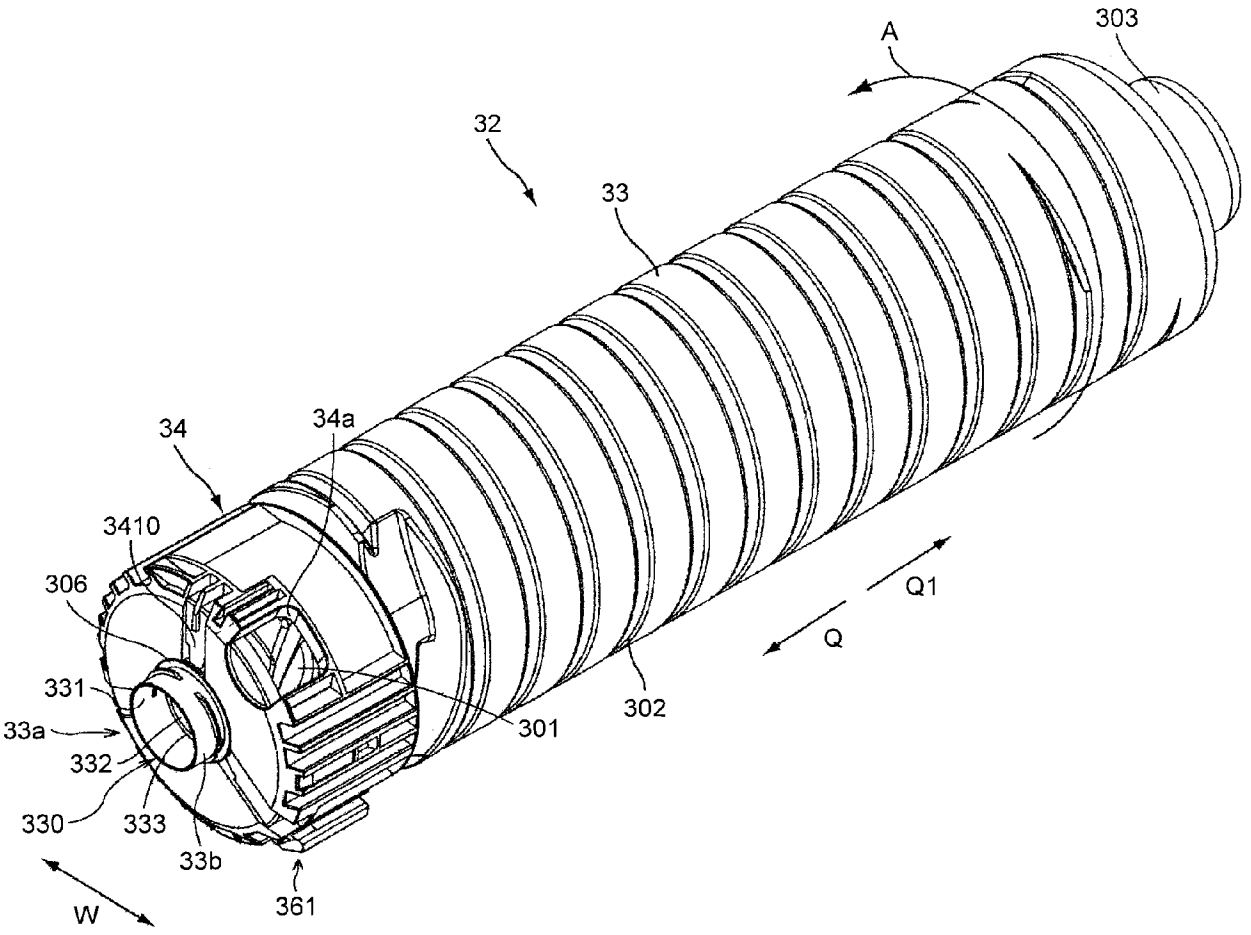
FIG. 7 is an explanatory perspective view illustrating a configuration of the powder container according to the embodiments.
Figure 8:
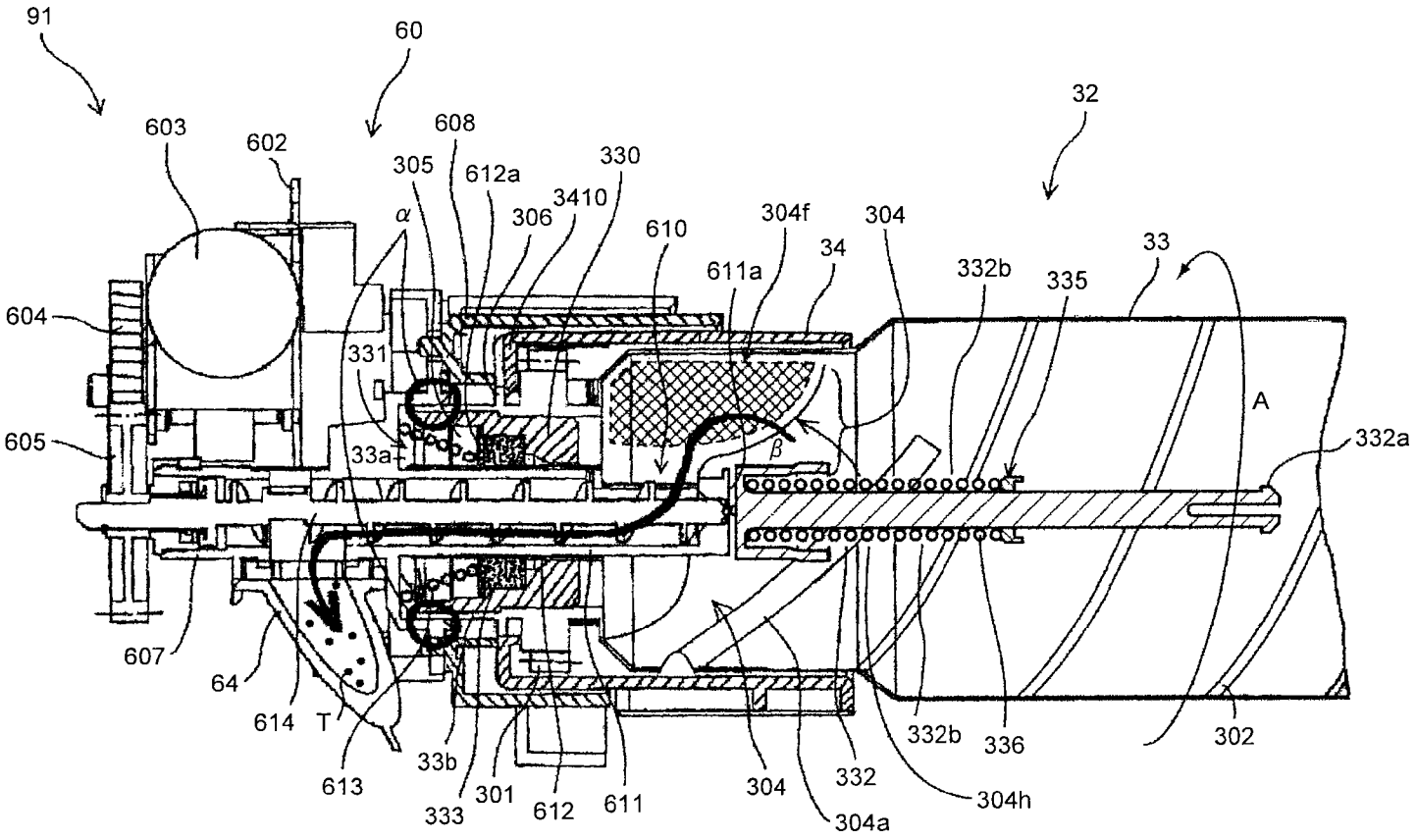
FIG. 8 is an explanatory cross-sectional view of the powder conveying device to which the powder container is attached and the powder container.
Figure 9:
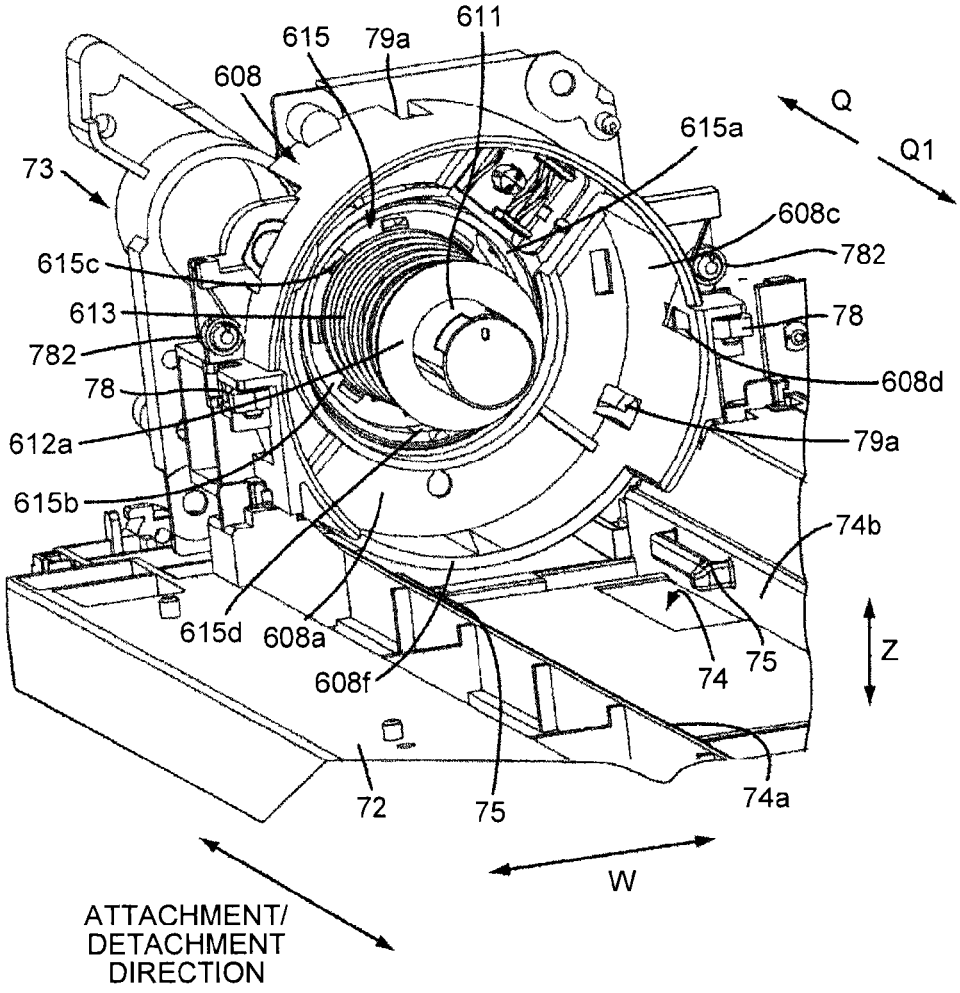
FIG. 9 is an explanatory partially-enlarged perspective view of the container holding section according to the embodiments.
Figure 10:
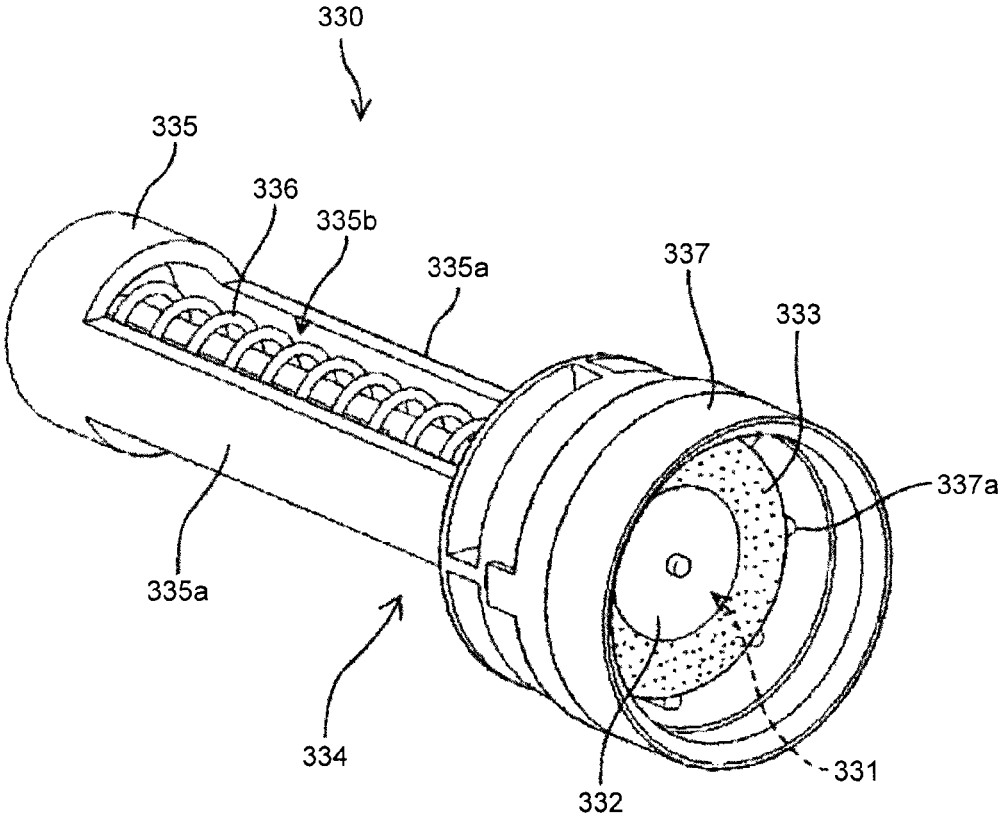
FIG. 10 is an explanatory perspective view illustrating a configuration of a nozzle insertion member.

FIG. 1 is an explanatory cross-sectional view of the toner replenishing device 60 before the toner container 32 is attached and a front end of the toner container 32. FIG. 7 is an explanatory perspective view of the toner container 32 viewed from above the container cover 34. FIG. 8 is an explanatory cross-sectional view of the toner replenishing device 60 to which the toner container 32 is attached and the front end of the toner container 32. FIG. 9 is a perspective view illustrating a configuration of the container cover receiving section 73 of the toner container holder 70.

The toner replenishing device 60 includes the conveying nozzle 611 in which the conveying screw 614 is arranged, and a nozzle shutter 612. The nozzle shutter 612 is slidably mounted on the outer surface of the conveying nozzle 611 so as to close the nozzle hole 610 at the time of detachment, which is before the toner container 32 is attached (in the state in FIG. 1), and to open the nozzle hole 610 at the time of attachment, which is when the toner container 32 is attached (in the state in FIG. 8). The nozzle shutter 612 includes a nozzle shutter flange 612*a* serving as a flange on the downstream side in the attachment direction relative to an end surface of a nozzle receiver 330 serving as a nozzle insertion member (to be described later) that comes in contact with the conveying nozzle 611.

As illustrated in FIG. 7, a receiving opening 331, which serves as a nozzle insertion opening into which the conveying nozzle 611 is inserted at the time of attachment, is provided in the center of the front end of the toner container 32. In the receiving opening 331, a container shutter 332 is provided, which serves as an opening/closing member that opens and closes the receiving opening 331. Specifically, the toner container 32 according to the embodiment stores therein toner and is able to supply toner from the nozzle receiver 330 to the conveying nozzle 611. The conveying nozzle 611 provided on the toner replenishing device 60 on the image forming apparatus side is inserted in and removed from the nozzle receiver 330. The copier 500 includes the conveying nozzle 611 that is inserted in the receiving opening 331 along with the attachment operation of the toner container 32 and that receives toner supplied from the toner container 32.

As illustrated in FIG. 4, the container receiving section 72 arranged on the toner container holder 70 is divided into four sections in a width direction W perpendicular to the longitudinal direction (attachment/detachment direction) of the toner container 32. The container receiving section 72 is provided with gutters 74 serving as container mounting sections as illustrated in FIG. 9. The gutters 74 extend from the insertion hole part 71 to the container cover receiving section 73 along the longitudinal direction of the container bodies 33Y, 33M, 33C, 33K. The toner containers 32Y, 32M, 32C, 32K for the respective colors are able to move on the gutters 74 in a sliding manner in the longitudinal direction.

As illustrated in FIG. 9, on side surfaces 74*a* and 74*b* of the gutter 74, which are opposite surfaces arranged in the width direction W, guide rails 75 are arranged so as to face each other. The guide rails 75 protrude in the width direction W from the respective side surfaces 74*a* and 74*b*, extend in the longitudinal direction, and are arranged in front of the container cover receiving section 73. The guide rails 75 are fitted to sliding guides 361 serving as guiding portions on the toner container 32 side as illustrated in FIG. 7 when the toner container 32 is attached to the printer 100 (the toner container holder 70 and the toner replenishing device 60). The fitting described herein means that the guide rails 75 are inserted in grooves provided on the sliding guides 361 in a movable manner. The guide rails 75 have functions to guide the container opening 33*a* serving as the opening to a container setting section 615 serving as a container receiving section by being fitted to the sliding guides 361. Each of the guide rails 75 is provided so as to be parallel to the rotation axis of the container body 33 when the toner container 32 is attached to the toner replenishing device 60.

As illustrated in FIG. 9, the setting cover 608 for each color is arranged on the container cover receiving section 73. The conveying nozzle 611 is disposed in the center of the setting cover 608. The conveying nozzle 611 is arranged so as to protrude from an end surface 615*b*, which is on the inner side in the attachment direction, of the container setting section 615, which is located on the downstream side in the attachment direction of the toner container 32, toward the upstream side in the attachment direction inside the container cover receiving section 73. The container setting section 615 serving as the container receiving section is arranged in the protruding direction of the conveying nozzle 611, that is, toward the upstream side in the attachment direction (to the detachment direction Q1 side) of the toner container 32 so as to surround the conveying nozzle 611. Specifically, the container setting section 615 is arranged at the base of the conveying nozzle 611 and serves as a positioner to determine the position of the container opening 33*a* relative to the toner container holder 70. The container opening 33*a* functions as a rotational shaft when the rotary conveyor inside the toner container 32 rotates to convey the toner stored in the toner container 32. Namely, when the container opening 33*a* is inserted in and mated to the container setting section 615, the radial position of the container opening 33*a* is determined.

When the toner container 32 is attached to the toner replenishing device 60, an outer surface 33*b* of the container opening 33*a* of the toner container 32 is slidably mated to the container setting section 615. On an inner surface 615*a* of the container setting section 615, contact surfaces 615*d* are provided. The contact surfaces 615*d* are parts of the inner surface 615*a* of the container setting section 615 and protrude inward in the radial direction from the inner surface 615*a* of the container setting section 615. The contact surfaces 615*d* are provided at four evenly-spaced positions. The contact surfaces 615*d* and the outer surface 33*b* slide against each other along with the rotation of the toner container 32.

By the mating of the inner surface 615*a* of the container setting section 615 and the outer surface 33*b* of the container opening 33*a* of the toner container 32, the position of the toner container 32 relative to the toner replenishing device 60 in the radial direction perpendicular to the longitudinal direction (attachment/detachment direction) of the toner container 32 is determined. When the toner container 32 rotates, the outer surface 33*b* of the container opening 33*a* functions as a rotational shaft, and the inner surface 615*a* of the container setting section 615 functions as a bearing. In FIG. 8, $\alpha$ indicates the position at which the outer surface 33*b* of the container opening 33*a* comes in sliding contact with the contact surfaces 615*d* as the parts of the inner surface 615*a* of the container setting section 615 and at which the radial position of the toner container 32 relative to the toner replenishing device 60 is determined at this time.

In the descriptions below, it is repeatedly explained that the outer surface 33*b* of the container opening 33*a* of the toner container 32 and the container setting section 615 mate with each other in a slidable manner. The mating state is, in a precise sense, a state in which the outer surface 33*b* of the container opening 33*a* of the toner container 32 is in contact with the contact surfaces 615*d* provided on the inner surface 615*a* of the container setting section 615. Hereinafter, for simplicity of explanation, the mating will be referred to as mating the outer surface 33*b* of the container opening 33*a* with the inner surface 615*a* of the container setting section 615 by omitting the contact surfaces 615*d*.

As illustrated in FIG. 9, holes 608*d* are provided so as to face each other in the width direction W of the setting cover 608. On the setting cover 608, replenishing device engaging members 78 (to be described later) are arranged so as to be able to move back and forth from the outer surface to an inner surface 608*c* side of the setting cover 608 via the holes 608*d*. The replenishing device engaging members 78 are biased from the outer side to the inner side of the setting cover 608 by biasing means, such as torsion coil springs 782.

The toner container 32 will be described below.

As illustrated in FIG. 7, the toner container 32 mainly includes the container body 33 containing toner, and includes the container cover 34. In FIG. 7, illustration of toner is omitted. The container body 33 is in the form of an approximate cylinder and rotates about a central axis of the cylinder as a rotation axis. Hereinafter, one side of the toner container 32 where the receiving opening 331 is provided (the side where the container cover 34 is arranged) in the longitudinal direction of the toner container 32 may be referred to as "a container front end". The other side of the toner container 32 where the gripper 303 is arranged (the side opposite the container front end) may be referred to as "a container rear end". The longitudinal direction of the toner container 32 is the rotation axis direction, and corresponds to the horizontal direction when the toner container 32 is attached to the toner replenishing device 60. The container rear end of the container body 33 relative to the container gear 301 has a greater outer diameter than that of the container front end, and the spiral rib 302 is provided on the inner surface of the container body 33. When the container body 33 rotates in an arrow A direction in the figures, a conveying force for moving toner from one end (the container rear end) to the other end (the container front end) in the rotation axis direction is applied to the toner in the container body 33 due to the action of the spiral rib 302.

As illustrated in FIG. 8, scooping portions 304 are provided on the inner wall of the container front end of the container body 33. The scooping portions 304 scoop up the toner T conveyed to the container front end by the spiral rib 302 along with the rotation of the container body 33 in the arrow A direction in the figures. Each of the scooping portions 304 scoops up the toner T, which has been conveyed by the conveying force of the spiral rib 302, by using a scooping wall surface 304*f* along with the rotation of the container body 33. Therefore, the toner T can be scooped up so as to be located above the inserted conveying nozzle 611. As illustrated in FIGS. 1 and 8 for example, a rib 304*a* in a spiral shape is provided on the inner surface of each of the scooping portions 304 in order to convey the internally-located toner, similarly to the spiral rib 302.

As illustrated in FIGS. 7 and 8, the container gear 301 is provided on the container front side relative to the scooping portions 304 on the container body 33. A gear exposing opening 34*a* is arranged on the container cover 34 so that a part of the container gear 301 can be exposed when the container cover 34 is attached to the container body 33. When the toner container 32 is attached to the toner replenishing device 60, the container gear 301 exposed from the gear exposing opening 34*a* meshes with the container driving gear 601 of the toner replenishing device 60. The container gear 301 is arranged on the container opening 33*a* side (near the container opening 33*a*) relative to the nozzle hole 610 in the longitudinal direction of the container body 33 such that the container gear 301 can mesh with the container driving gear 601. The container gear 301 meshes with the container driving gear 601 to thereby rotate the rotary conveyor.

The container opening 33*a* in the form of a cylinder is provided on the container front side relative to the container gear 301 of the container body 33 so as to be coaxial with the container gear 301. As illustrated in FIGS. 1 and 8, a nozzle receiver attachment portion 337 of the nozzle receiver 330 is press fitted to the container opening 33*a* so as to be coaxial with the container opening 33*a*, so that the nozzle receiver 330 is fixed to the container body 33. The toner container 32 is configured such that toner T is replenished from the container opening 33*a* serving as the opening provided on one end of the container body 33, and thereafter, the nozzle receiver 330 is attached to the container opening 33*a* of the container body 33.

As illustrated in FIG. 7, a cover hook stopper 306 serving as a restrictor is provided between the container opening 33*a* of the container body 33 and the container gear 301. The cover hook stopper 306 has a ring shape extending in the rotation direction (circumferential direction) on the front end of the container cover 34 in the attachment direction.

The container cover 34 is attached to the toner container 32 (the container body 33) from the container front end (from the bottom left side in FIG. 8). Therefore, the container body 33 penetrates through the container cover 34 in the longitudinal direction, and cover hooks 3410 serving as protrusions are engaged with the cover hook stopper 306 serving as the restrictor. The container body 33 and the container cover 34 are attached so as to rotate relative to each other when the cover hooks 3410 are engaged with the cover hook stopper 306.

As illustrated in FIG. 7, on the container cover 34 of the toner container 32, the sliding guides 361 serving as guiding portions are provided on lower portions in the width direction W. In FIG. 7, only one of the sliding guides 361 is illustrated. Each of the sliding guides 361 restricts the toner container 32 being attached from moving in directions other than the attachment direction to thereby guide the container opening 33*a* to the container setting section 615. Each of the sliding guides 361 includes a gutter extending in the longitudinal direction of the container body 33. The sliding guides 361 are configured such that the guide rails 75, as a pair, provided on the gutters 74 of the container receiving section 72 as illustrated in FIG. 9 are inserted in the respective gutters and sandwiched in the vertical direction. Therefore, the sliding guides 361 function as positioners of the container cover 34 in the width direction W perpendicular to a vertical direction Z and the detachment direction Q1 when the toner container 32 is attached to the printer 100 (the toner replenishing device 60 and the toner container holder 70).

A configuration of the nozzle receiver 330 will be described below with reference to FIGS. 10 and 11A to 11D. As illustrated in FIGS. 11A to 11D, the nozzle receiver 330 is arranged on the toner container 32, and includes the receiving opening 331 serving as a nozzle insertion opening. The conveying nozzle 611 for conveying toner supplied from the toner container 32 in the copier 500 is inserted in and removed from the receiving opening 331. The nozzle receiver 330 includes the container shutter 332, a container seal 333 serving as a seal, a container shutter supporter 334 serving as a supporter, a container shutter spring 336 serving as a biasing member, and the nozzle receiver attachment portion 337. The container shutter 332 is inserted in and supported by the container shutter supporter 334 in a reciprocating manner so as to move to the opening position to open the receiving opening 331 by being pressed along with insertion of the conveying nozzle 611, and to move a closing position to close the receiving opening 331 along with removal of the conveying nozzle 611. Namely, the container shutter supporter 334 supports the container shutter 332 so as to guide the container shutter 332 to move to the opening position and the closing position. The container shutter spring 336 is a coil spring that is arranged inside the container shutter supporter 334 and biases the container shutter 332 toward the closing position. While the container shutter spring 336 biases the container shutter 332 toward the closing position in the embodiment, a configuration without the container shutter spring 336 may be applicable.

The container shutter supporter 334 includes a shutter rear end supporting portion 335 as a rear portion, a pair of shutter side supporting portions 335*a* as side portions, the openings 335*b* as shutter side openings of the container shutter supporter, and the nozzle receiver attachment portion 337. The shutter side supporting portions 335*a* are arranged so as to face each other, and extend along the moving direction of the container shutter 332. One ends of the shutter side supporting portions 335*a* are connected by the shutter rear end supporting portion 335, and the other ends are connected to the cylindrical nozzle receiver attachment portion 337. The shutter side supporting portions 335*a* and the openings 335*b* are arranged adjacent to each other in the rotation direction of the toner container. Namely, the container shutter supporter 334 has a shape in which cylindrical portions corresponding to the shutter side supporting portions 335*a* from the nozzle receiver attachment portion 337 side to the shutter rear end supporting portion 335 are vertically cut out along the moving direction of the container shutter 332. The openings 335*b* are provided in the cutout portions of the container shutter supporter 334. The container shutter supporter 334 is configured such that the container shutter 332 can move along the insertion direction of the conveying nozzle 611 in a space S1. The space S1 is enclosed by the pair of the shutter side supporting portions 335*a*, the shutter rear end supporting portion 335, and the nozzle receiver attachment portion 337. In other words, the container shutter supporter 334 is configured to be able to guide the movement of the container shutter 332 to the opening position to open the receiving opening 331 and the closing position to close the receiving opening 331.

Figure 11A:
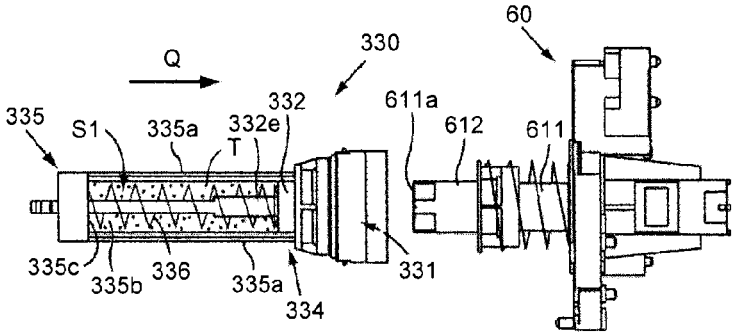
FIGS. 11A to 11D are top plan views for explaining states of the opening/closing member and a conveying nozzle in attachment operation.
Figure 11B:
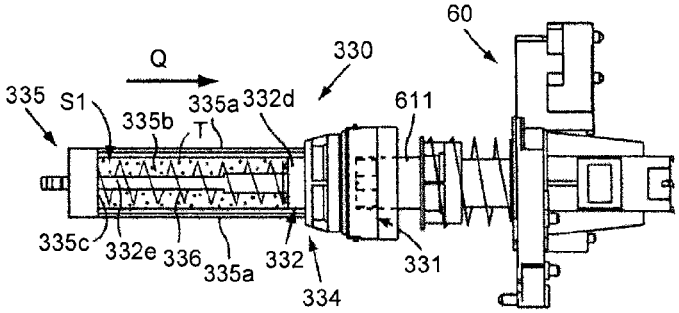
Figure 11C:
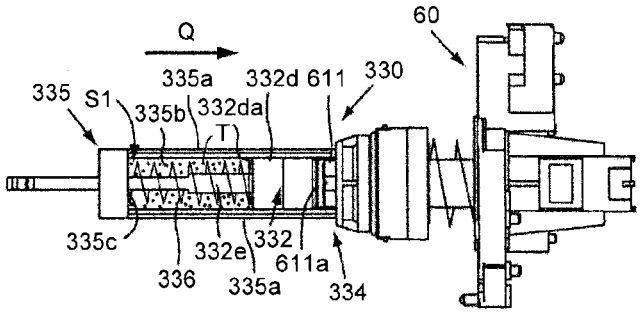
Figure 11D:
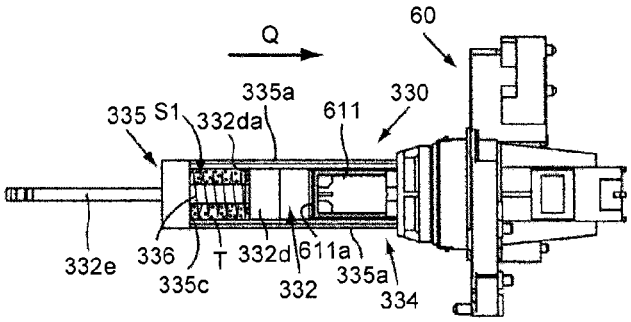

As illustrated in FIGS. 11A to 11D, the conveying nozzle 611 is inserted in the nozzle receiver 330, and the container shutter 332 starts to move by being pushed by a front end (end surface) 611*a* of the conveying nozzle 611. At this time, the toner T remains in the space S1. The space S1 is defined by the two shutter side supporting portions 335*a* of the container shutter supporter 334 that guides the container shutter 332 and by the shutter rear end supporting portion 335 of the container shutter supporter 334. The container shutter spring 336 is held in the space S1. The shutter rear end supporting portion 335 has a cylindrical shape; therefore, the toner T is likely to be accumulated in the cylindrical portion. Therefore, as illustrated in FIGS. 11B to 11D, the toner T is pressed between a rear end surface (edge) 332*da* of a slide area (gliding portion or sealing portion) 332*d* of the container shutter 332 and an opposite surface of the shutter rear end supporting portion 335 of the nozzle receiver 330.

The toner T is pressed and compressed between the rear end surface 332*da* of the slide area 332*d* of the container shutter 332 and the opposite surface of the shutter rear end supporting portion 335 of the container shutter supporter 334 (the nozzle receiver 330) as described above. Therefore, when the toner container 32 is further pushed, the compressed toner enters between the slide area 332*d* of the container shutter 332 and the two shutter side supporting portions 335*a* of the container shutter supporter 334 (the nozzle receiver 330). If the compressed and cohered toner enters between the slide area 332*d* of the container shutter 332 and the two shutter side supporting portions 335*a* of the container shutter supporter 334 (the nozzle receiver 330) as described above, the container shutter 332 is prevented from returning to the closing position when the toner container 32 is detached from the copier 500. Consequently, the toner container 32 may be detached while the receiving opening 331 remains open, resulting in toner leakage.

Figure 12A:
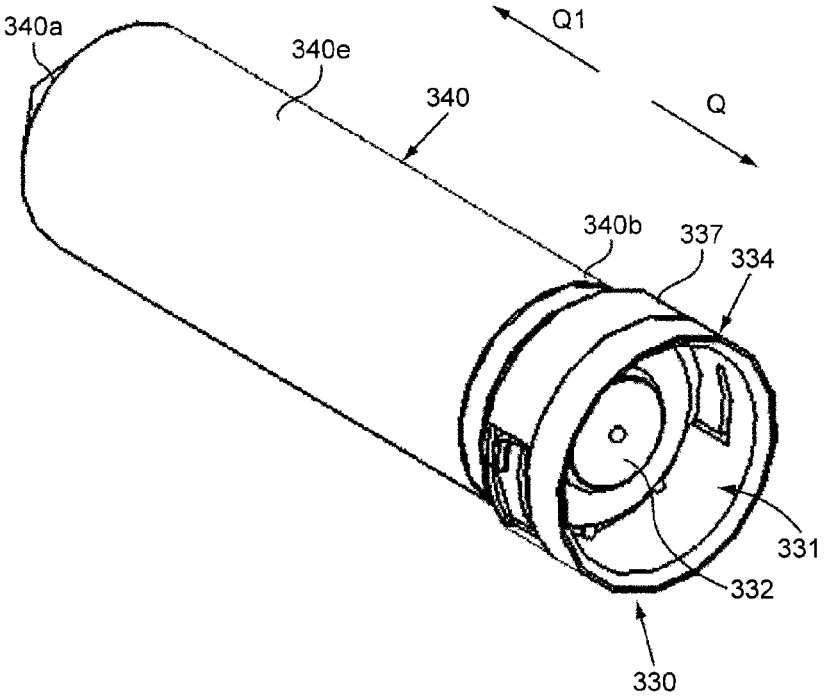
FIG. 12A is an explanatory perspective view illustrating a configuration of the nozzle insertion member including an inner cap according to a first embodiment, when viewed from a nozzle insertion side.
Figure 12B:
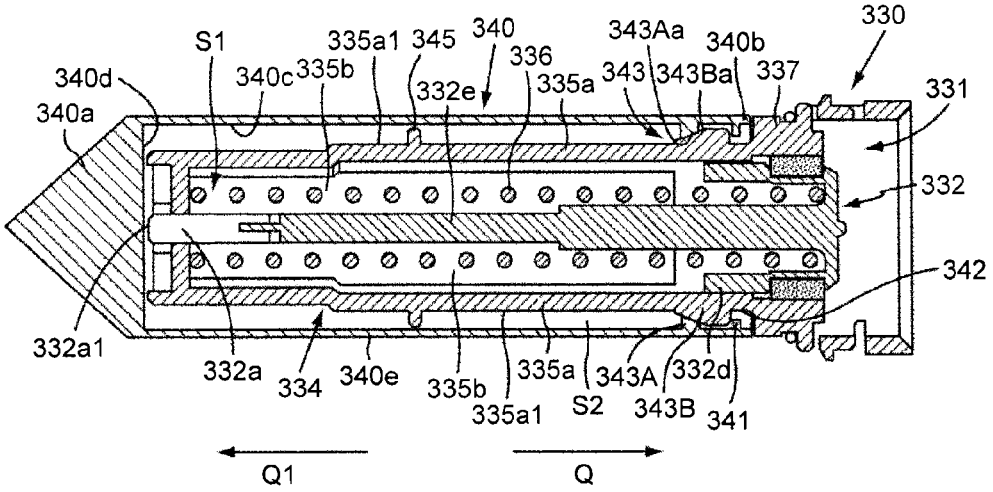
FIG. 12B is an explanatory cross-sectional view of the nozzle insertion member including the inner cap according to the first embodiment.

Therefore, the nozzle receiver 330 serving as the nozzle insertion member according to the embodiment includes an inner cap 340 as illustrated in FIGS. 12A and 12B. The inner cap 340 longitudinally covers the slide area 332*d* and the container shutter supporter (supporter) 334 when the slide area (sealing portion) 332*d* of the container shutter (opening/closing member) 332 is located at the closing position. By covering the container shutter supporter 334 by the inner cap 340 from the outside, it is possible to obtain an approximately sealed state so as to prevent the toner T from entering between the slide area 332*d* of the container shutter 332 and the two shutter side supporting portions 335*a* of the nozzle receiver 330. Therefore, it is possible to prevent the toner T from entering the space S1 in which the container shutter 332 moves along with opening and closing of the receiving opening 331 as illustrated in FIGS. 11A to 11D. This prevents the toner T from being compressed. Therefore, the container shutter 332 is not prevented from returning to the closing position, so that it becomes possible to prevent the toner container 32 from being detached while the receiving opening 331 remains open, enabling to prevent toner leakage.

Configurations of the inner cap 340 and the container shutter supporter 334 to which the inner cap 340 is attached will be described below.

Figure 14A:
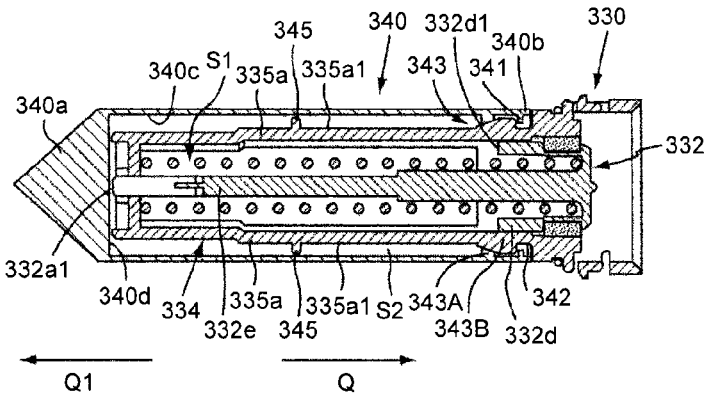
FIG. 14A is a diagram for explaining operation of the opening/closing member and the inner cap at the time of attachment of the powder container, and illustrating a state in which the inner cap is located at a closure position.
Figure 14B:
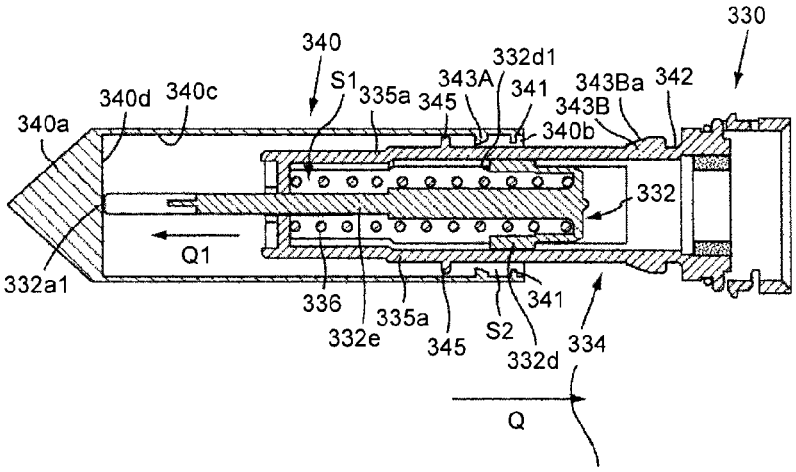
FIG. 14B is a diagram illustrating a state in which the inner cap is moving from the closure position to a release position.
Figure 14C:
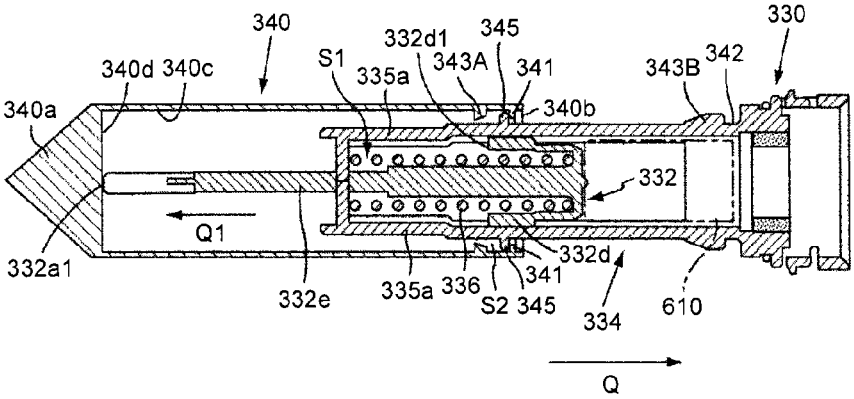
FIG. 14C is a diagram illustrating a state in which the inner cap is located at the release position.

The inner cap 340 is supported on the outer side of the container shutter supporter 334 so as to be able to slide between a closure position, at which the two shutter side supporting portions 335*a* of the container shutter supporter 334 are covered as illustrated in FIG. 14A, and a release position, at which parts of the two shutter side supporting portions 335*a* are opened as illustrated in FIG. 14C. Namely, the inner cap 340 is movable along the longitudinal sides of the shutter side supporting portions 335*a*. The release position of the inner cap 340 is a position at which the nozzle hole 610 is opened between the two shutter side supporting portions 335*a* when the conveying nozzle 611 is inserted in the container shutter supporter 334 (for example, see FIG. 8). Specifically, when the inner cap 340 is located at the closure position, the entire longitudinal area of the container shutter supporter 334 is covered by the inner cap 340 from the outside. When the inner cap 340 is located at the release position, a part of the container shutter supporter 334 is exposed. More specifically, when the inner cap 340 is located at the release position, a part of the container shutter supporter 334 is exposed such that the nozzle hole 610 of the conveying nozzle 611 is exposed between the two shutter side supporting portions 335*a* of the container shutter supporter 334 so as to communicate with the inside of the toner container 32 to enable toner supply.

As illustrated in FIG. 12B, the inner cap 340 has a cylindrical shape with a closed end 341*a* on one end in the longitudinal direction and with an opening 340*b* on the other end. The size and the length of the internal space are defined so as to cover the container shutter supporter 334 from the outside. On the opening 340*b* side of the inner cap 340, an inner side protrusion 341 is provided so as to protrude toward the inside of the cap relative to an inner surface 340*c* of the inner cap 340. Specifically, the inner side protrusion 341 protrudes toward outer surfaces 335*a*1 of the container shutter supporter 334 housed in the inner cap 340. The inner side protrusion 341 may be provided circularly in the circumferential direction of the inner cap 340, or may be provided intermittently in the circumferential direction of the inner cap 340. On the inner surface 340*c* between the inner side protrusion 341 and a closed end 340*a* that is a closure portion of the inner cap, a sealing protrusion 343A protrudes toward the inside of the cap so as to have a ring shape.

The inner cap 340 configured as described above is attached from the opening 340*b* at the leading end in a direction from a shutter hook 332*a* side to the nozzle receiver attachment portion 337. The shutter hook 332*a* is provided on the front end of a guiding rod (elongated portion) 332*e* that is a part of the container shutter 332. Specifically, the container shutter supporter 334 of the nozzle receiver 330 is inserted in the inner cap 340 from the opening 340*b* to the closed end 340*a* of the inner cap 340.

On the closed end 340*a*, an opposing surface 340*d* as an inner end surface is provided. The opposing surface 340*d* faces an end surface 332*a*1 of the shutter hook 332*a* when the inner cap 340 is attached to the container shutter supporter 334. The end surface 332*a*1 is a part of the container shutter (opening/closing member) 332. The opposing surface 340*d* is a flat surface that crosses the moving direction of the container shutter 332. It is more preferable that the opposing surface 340*d* be a flat surface perpendicular to the moving direction of the container shutter 332. The opposing surface 340*d* is disposed on an opening position side of the container shutter 332 so as to be pushed by the end surface 332*a*1 of the shutter hook 332*a* when the container shutter 332 moves to the opening position. Specifically, the inner cap 340 includes the opposing surface 340*d* serving as the inner end surface that comes in contact with the end surface 332*a*1 of the shutter hook 332*a* that is a part of the container shutter 332 when the container shutter 332 moves to the opening position.

The inner cap 340 is configured such that a projected area of the outer surface of the closed end 340*a*, which is an end on a release position side, in the moving direction of the container shutter 332 is smaller than the projected area of a cylindrical portion 340*e*, which is a portion on a closure position side, in the moving direction of the container shutter 332. In the embodiment, the closed end 340*a* has a conical shape and has a smaller projected area than the projected area of the cylindrical portion 340*e*.

Figure 13A:
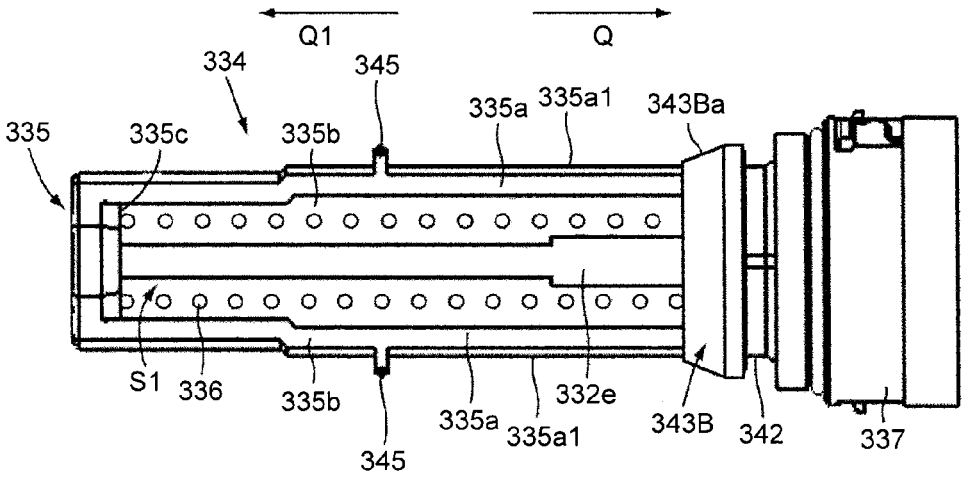
FIG. 13A is a side view for explaining a configuration of a container shutter supporter to which the inner cap is to be attached.
Figure 13B:
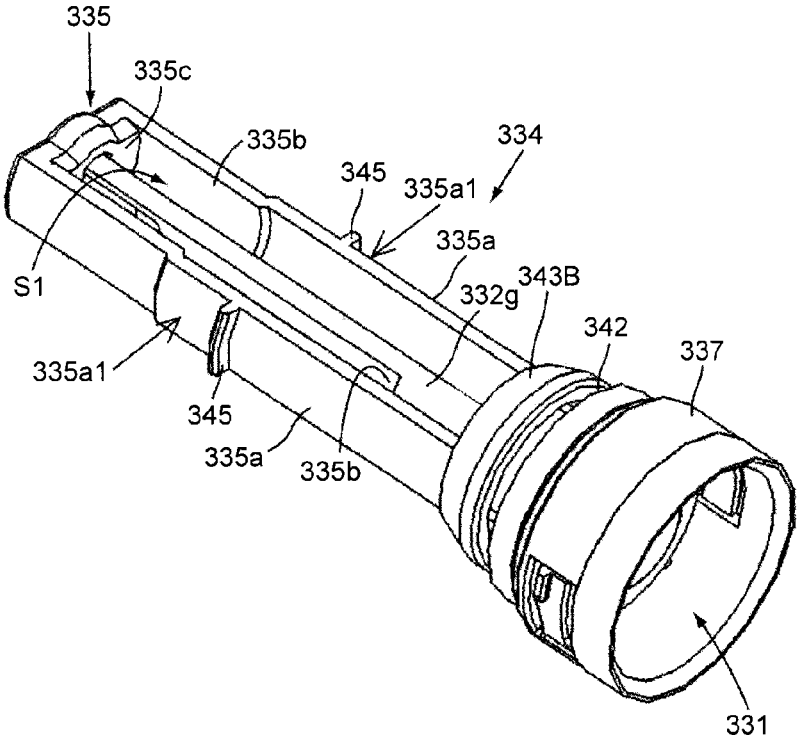
FIG. 13B is a perspective view of the container shutter supporter when viewed from the nozzle insertion side.

On the two shutter side supporting portions 335*a* of the container shutter supporter 334, as illustrated in FIGS. 12B, 13A, and 13B, cap stoppers 345 are provided. The cap stoppers 345 protrude from the outer surfaces 335*a*1 of the supporter to the inner surface 340*c* of the inner cap 340, and are disposed on the release position side relative to the inner side protrusion 341. The cap stoppers 345 come in contact with the inner side protrusion 341 near the release position when the inner cap 340 is pushed along with the movement of the container shutter 332 to the opening position, and restricts the movement of the inner cap 340 in the pushing direction (the moving direction Q1 toward the opening position) in order to prevent the inner cap 340 from being detached from the container shutter supporter 334. Specifically, the shutter side supporting portions 335*a* include the cap stoppers 345 protruding from the outer surfaces 335*a*1 of the shutter side supporting portions 335*a* to the inner surface 340*c* of the inner cap 340.

The container shutter supporter 334 includes an engaging groove 342. The engaging groove 342 serves as a cap holder and is provided at the supporter that is engaged with the inner side protrusion. The engaging groove 342 holds the inner cap 340 when the inner cap 340 is located at the closure position at which it longitudinally covers the container shutter supporter 334 as illustrated in FIGS. 12B and 14A. The engaging groove 342 is disposed between the two shutter side supporting portions 335*a* and the nozzle receiver attachment portion 337, and faces the slide area 332*d* when the container shutter 332 is located at the closing position. The engaging groove 342 is a groove recessed from the outer surfaces 335*a*1 toward the slide area 332*d*. The inner side protrusion 341 is inserted in and hooked on the engaging groove 342 provided as the groove when the inner cap 340 is attached to the container shutter supporter 334. When the inner side protrusion 341 is hooked on the engaging groove 342, the inner cap 340 is held at the closure position.

As illustrated in FIG. 12B, the nozzle receiver 330 includes a sealing portion 343 that seals a space S2 between the shutter side supporting portions 335*a* (the container shutter supporter 334) and the inner surface 340*c* of the inner cap 340 when the inner cap 340 is located at the closure position. The sealing portion 343 includes the sealing protrusion 343A provided on the inner cap 340 and a sealing surface 343B provided on the shutter side supporting portions 335*a* (the container shutter supporter 334). The sealing surface 343B of the supporter protrudes from the outer surfaces 335*a*1 of the shutter side supporting portions 335*a* toward the inner surface 340*c* of the inner cap 340. The sealing surface 343B of the supporter comes in contact with the sealing protrusion 343A when the inner cap 340 is attached to the container shutter supporter 334, in particular, when the inner cap 340 approaches the closure position, or more preferably, when the inner cap 340 is located at the closure position, and seals a gap between the shutter side supporting portions 335*a* (the container shutter supporter 334) and the inner surface 340*c* of the inner cap 340.

The sealing surface 343B of the supporter includes an inclined surface 343Ba. The inclined surface 343Ba has a ring shape and inclined downward in a cap moving direction (an arrow Q1 direction in the figure) in which the inner cap 340 is pushed and moved from the closure position to the release position along with the movement of the container shutter 332. The inclined surface 343Ba faces a sealing surface (contacting surface) 343Aa of the sealing protrusion 343A, and comes in contact with an inner surface 343*a* on the release position side relative to the closure position when the inner cap 340 moves. Specifically, the inclined surface 343Ba is configured such that when the inner cap 340 moves to the release position, the sliding resistance against the sealing surface 343Aa is reduced and the container shutter 332 can smoothly move in the opening direction, and, when the inner cap 340 moves to the closure position, the sliding resistance against the inner surface 343*a* is increased and a sealing performance can be ensured. To ensure a higher sealing performance, it is preferable that the sealing surface 343Aa of the sealing protrusion 343A be provided as an inclined surface parallel to the inclined surface 343Ba.

When the inner cap 340 moves to the release position, the inner side protrusion 341 provided on the closure position side relative to the sealing protrusion 343A is separated from the engaging groove 342 and moves on the inclined surface 343Ba of the sealing surface 343B. When the inner cap 340 moves to the closure position, the inner side protrusion 341 passes on the inclined surface 343Ba, enters the engaging groove 342, and is held by the engaging groove 342. Therefore, the inner side protrusion 341 is provided so as to be elastically deformable.

Movement of the inner cap 340 between the closure position and the release position will be described below with reference to FIGS. 14A to 14C. FIG. 14A illustrates the states of the inner cap 340, the container shutter 332, and the container shutter supporter 334 when the inner cap 340 is located at the closure position. FIG. 14B illustrates the states of the inner cap 340, the container shutter 332, and the container shutter supporter 334 when the inner cap 340 is moving from the closure position to the release position. FIG. 14C illustrates the states of the inner cap 340, the container shutter 332, and the container shutter supporter 334 when the inner cap 340 is located at the release position.

As illustrated in FIG. 14A, when the inner side protrusion 341 enters the engaging groove 342, the inner cap 340 is held by the container shutter supporter 334 at the closure position. At this time, the container shutter supporter 334 is in the approximately sealed state. Therefore, a container sealed side of the container shutter supporter 334 (the nozzle receiver 330) is covered by the inner cap 340 until the toner container 32 is set in the toner replenishing device 60, and the toner T does not enter between the slide area 332*d* of the container shutter 332 and the two shutter side supporting portions 335*a* of the nozzle receiver 330. Consequently, even if the fluidity of the toner T is reduced due to transportation or storage, the toner T is not compressed. Therefore, the container shutter 332 is not prevented from moving back to the closing position when the toner container 32 is detached from the copier 500. Consequently, it is possible to prevent the toner container 32 from being detached while the receiving opening 331 remains open, enabling to prevent toner leakage. Namely, it is possible to prevent the toner T from entering an opening/closing region of the container shutter 332, and it is possible to more reliably prevent a situation in which the container shutter 332 is prevented from returning to the closing position by the toner T.

When the toner container 32 is moved in the attachment direction Q of the toner replenishing device 60, the container shutter 332 is moved in the opening direction (arrow Q1) by the conveying nozzle 611. Therefore, the opposing surface 340*d* of the inner cap 340 is pushed by the end surface 332*a*1 of the shutter hook 332*a* of the container shutter 332, and the inner side protrusion 341 is elastically deformed and separated from the engaging groove 342. As a result, the approximately sealed state is released. Further, the contact state of the contacting surface 343Aa of the sealing protrusion 343A and the inclined surface 343Ba of the sealing surface 343B of the supporter is released.

When the container shutter 332 is further moved in the opening direction by the conveying nozzle 611, as illustrated in FIG. 14B, the inner cap 340 moves from the closure position to the release position along with the movement of the container shutter 332. Then, the sealing protrusion 343A passes by the cap stopper 345. When the container shutter 332 is further moved in the opening direction by the conveying nozzle 611, as illustrated in FIG. 14C, the inner side protrusion 341 comes in contact with the cap stopper 345, and the inner cap 340 is located at the release position and is restricted from moving further. Therefore, it is possible to prevent the inner cap 340 from coming off from the container shutter supporter 334. By preventing the inner cap 340 from coming off, it is possible to prevent the inner cap 340 from rolling and causing a noise to occur in the toner container 32, or to prevent the inner cap 340 from covering the conveying nozzle 611 and disturbing toner conveyance.

In the embodiment, the contacting surface 343Aa of the sealing protrusion 343A and the inclined surface 343Ba of the sealing surface 343B of the supporter in the sealing portion 343 are provided as inclined surfaces. Therefore, the inclined contacting surface 343Aa of the sealing protrusion 343A and the inclined surface 343Ba of the sealing surface 343B of the supporter come in close contact with each other in the circumferential direction. Consequently, it is possible to reliably maintain the sealed state of the container shutter supporter 334 by the inner cap 340.

In the embodiment, the outer surface of the closed end 340*a* of the inner cap 340 has a conical shape so as to have a smaller projected area than the projected area of the cylindrical portion 340*e*. More specifically, the inner cap 340 is in the form of a protrusion such that it protrudes from the closed end 340*a* (end portion) located distant from the slide area 332*d* in the longitudinal direction when the container shutter 332 is located at the closing position, and such that the projected area is reduced from the upstream side to the downstream side in the moving direction in which the container shutter 332 moves from the closing position to the opening position. If the fluidity of toner around the inner cap 340 is reduced due to transportation or storage, this causes resistance when the container shutter 332 moves in the opening direction occurs. However, by reducing the projected area of the closed end 340*a* located on a moving direction side to which the container shutter 332 moves along the opening direction, it is possible to reduce the resistance.

Figure 15:
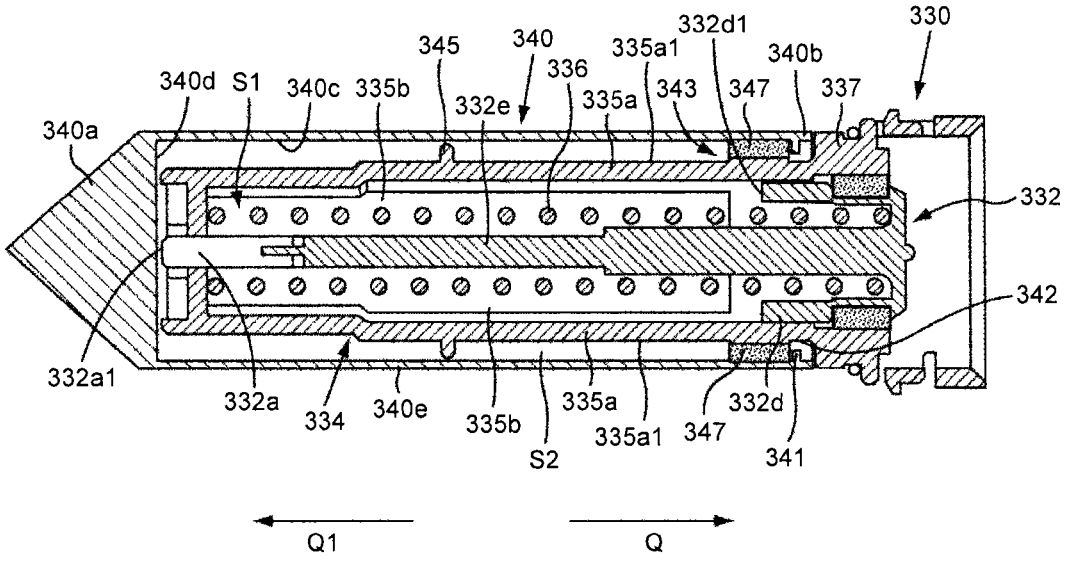
FIG. 15 is an explanatory cross-sectional view of another example of a sealing portion in the nozzle insertion member including the inner cap according to the first embodiment.

In the embodiment, the sealing portion 343 is configured such that the sealing protrusion 343A is provided on the inner cap 340, the sealing surface 343B is provided on the two shutter side supporting portions 335*a*, and the contacting surface 343Aa and the inclined surface 343Ba are provided as inclined surfaces parallel to each other; however, the configuration is not limited thereto. For example, as another example as illustrated in FIG. 15, the sealing portion may be configured such that a seal 347 made of an elastic material or a foamed material is disposed between the outer surfaces 335*a*1 of the two shutter side supporting portions 335*a* and the inner surface 340*c* of the inner cap 340. In this case, because the two shutter side supporting portions 335*a* and the inner cap 340 move relative to each other, it is preferable to provide the seal 347 on only one of the outer surfaces 335*a*1 of the shutter side supporting portions 335*a* and the inner surface 340*c* of the inner cap 340 so as to come in contact with or be press fitted to both of the surfaces, in view of ensuring the sealing performance.

In this configuration, less stress is applied at the time of sealing, as compared to the configuration in which the sealing protrusion 343A and the sealing surface 343B of the supporter are provided as protrusions protruding from the inner surface 340*c* of the inner cap 340 and the outer surfaces 335*a*1 of the two shutter side supporting portions 335*a*. Therefore, higher assembly performance and higher durability can be obtained. Thus, there is an advantage that the sealed state of the container shutter supporter 334 by the inner cap 340 can more reliably be ensured.

Figure 16:
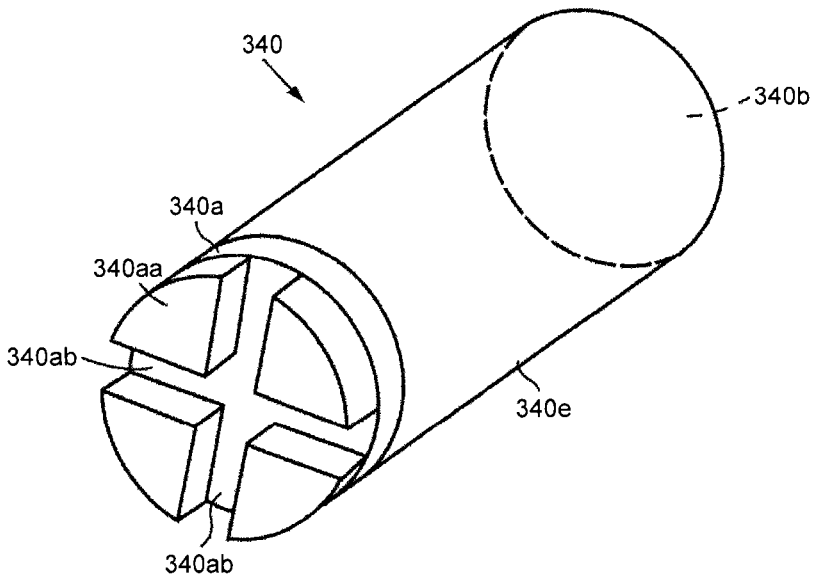
FIG. 16 is a perspective view for explaining another example of the inner cap according to the first embodiment.

The resistance occurs when the container shutter 332 moves in the opening direction. To cope with this, in the embodiment, the outer surface (external appearance) of the closed end 340*a* has a conical shape in order to reduce the projected area of the closed end 340*a* that is located on the moving direction side to which the container shutter 332 moves along the opening direction, as compared to the projected area of the cylindrical portion 340*e* that is located in the direction opposite to the moving direction along the opening direction. However, as long as the projected area of the closed end 340*a* is smaller than the projected area of the cylindrical portion 340*e*, the shape is not limited to the conical shape. As the configuration of the closed end 340*a*, as still another example as illustrated in FIG. 16, it may be possible to provide, on the inner cap 340, an end surface 340*aa* perpendicular to the moving direction of the container shutter 332 and grooves 340*ab* at the end surface 340*aa* in order to reduce the projected area of the cylindrical portion 340*e* in the moving direction of the container shutter 332.

Second Embodiment

A second embodiment of the present invention will be described below with reference to FIGS. 17 to 23. The same components as those of the first embodiment will be denoted by the same reference signs.

In the first embodiment, the container shutter supporter 334 is covered by the inner cap 340 from the outside so as to prevent the toner T from entering the space S1 between the two shutter side supporting portions 335*a* of the nozzle receiver 330 during transportation of the toner container 32 or the like. In other words, by providing the inner cap 340, the toner T is not compressed when the container shutter 332 moves from the closing position to the opening position. Therefore, the container shutter 332 is not prevented from moving back to the closing position by compressed toner T. Consequently, it is possible to prevent the toner container 32 from being detached while the receiving opening 331 remains open, enabling to prevent toner leakage.

Even in the second embodiment of the present invention, the toner T is prevented from entering a space (movement space) S3 in a moving region of the container shutter 332 inside the container shutter supporter 334 in order to address the above described issue. Therefore, the second embodiment is based on the same technical ideas as those of the first embodiment.

The space S1 is a space enclosed by the shutter side supporting portions 335*a*, the shutter rear end supporting portion 335, and the nozzle receiver attachment portion 337, and therefore is greater than the space S3.

Detailed explanation will be given below with reference to the drawings.

Figure 17:
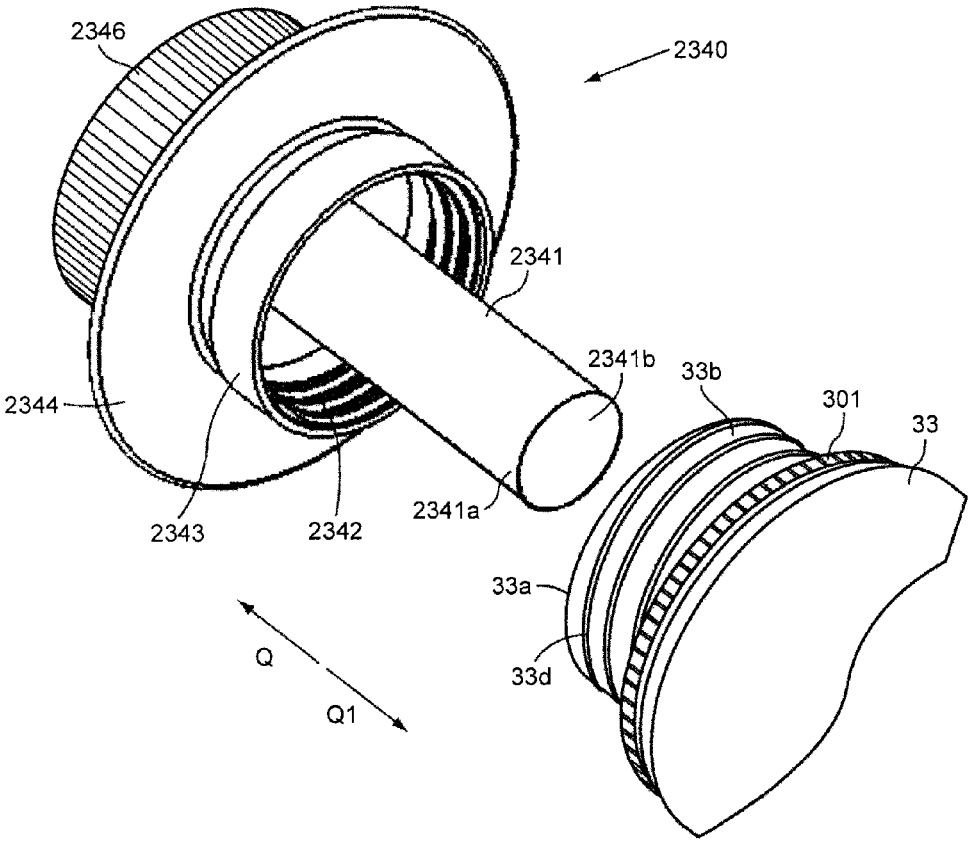
FIG. 17 is an enlarged perspective view for explaining a configuration of a cap (outer cap) according to a second embodiment.

In the second embodiment, as illustrated in FIG. 17, an insertion part 2341 to be inserted in the receiving opening 331 is provided on a cap (outer cap) 2340 that is detachably attached to the outer surface 33*b* of the container opening 33*a* and that seals the receiving opening 331 and the container opening 33*a* when attached to the outer surface 33*b* of the container opening 33*a*.

Figure 18:
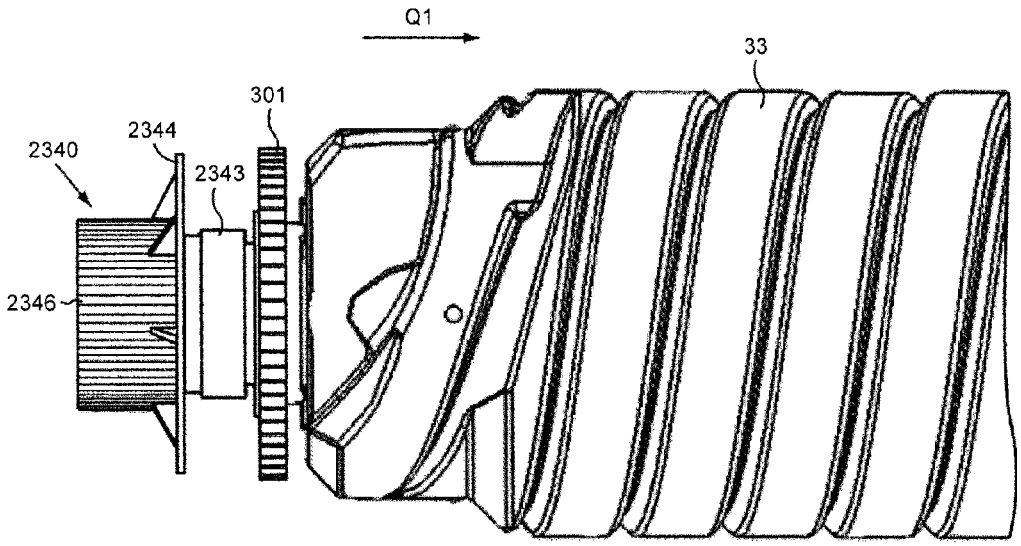
FIG. 18 is an external view for explaining an attachment state of the cap according to the second embodiment.
Figure 19:
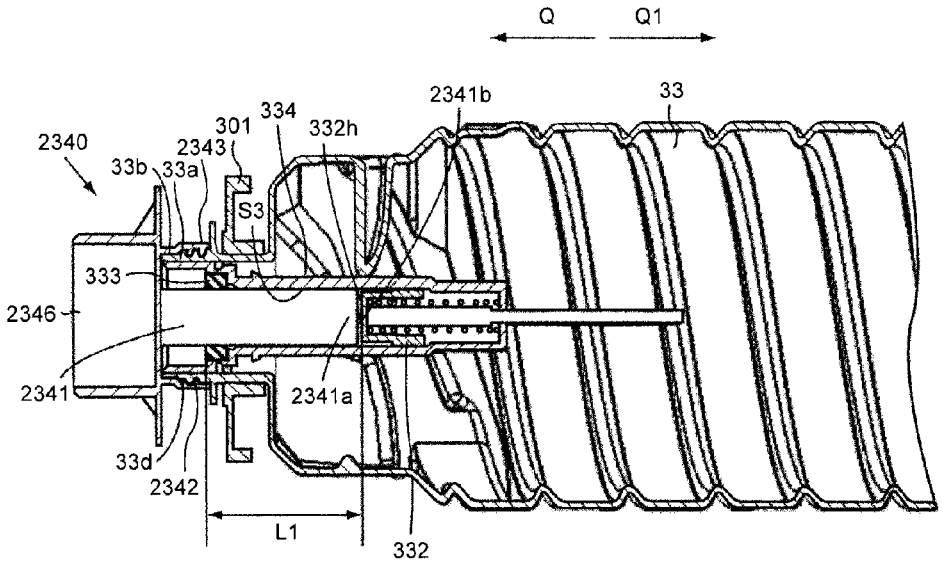
FIG. 19 is a cross-sectional view for explaining the attachment state of the cap according to the second embodiment.

The cap 2340 is made of resin. The cap 2340 is provided with a female screw 2342 inside a closed-end inside space 2343 of the screw of the cap, that is, inside a cap space. The female screw 2342 is screwed with a male screw 33*d* provided on the outer surface 33*b* of the container opening 33*a*. The female screw 2342 may be provided on the outer surface 33*b* and the male screw 33*d* may be provided on the inside space 2343. The inside space 2343 is provided so as to protrude from a disk-shaped base 2344 in an axial direction (the detachment direction Q1). A handle 2346 is provided on the side opposite to the inside space 2343 across the base 2344. The cap 2340 is attached to the outer surface 33*b* of the container opening 33*a* (the container body 33) by screwing the female screw 2342 with the male screw 33*d*. In the second embodiment, a position at which the cap 2340 is fully screwed and attached to the outer surface 33*b* of the container opening 33*a* as illustrated in FIGS. 18 and 19 is referred to as an attachment completed position.

The insertion part 2341 is a rod portion extending from the base 2344 in the axial direction, and includes an end portion 2341*a* that is located on the opening position side of the container shutter 332 relative to an end portion 2343*a* of the inside space 2343 and that protrudes outward. The insertion part 2341 pushes the container shutter 332 toward the inside of the container body 33 when the cap 2340 is attached to the outer surface 33*b* of the container opening 33*a*. Specifically, the end portion 2341*a* includes a contact surface 2341*b* that faces and comes in contact with an end surface 332*h* of the front cylindrical portion of the container shutter 332.

The insertion part 2341 has a length L2 so as to fill the space (movement space) S3 of a moving region L1 of the container shutter 332 inside the container shutter supporter 334 when the cap 2340 is located at the attachment completed position.

When the cap 2340 configured as described above is attached to the outer surface 33*b* of the container opening 33*a* of the container body 33, it is possible to prevent the toner T with the low fluidity from entering the space (movement space) S3 of the moving region L1 of the container shutter 332. Therefore, is possible to prevent a situation in which the toner inside the container body 33 prevents the container shutter 332 from moving to the closing position.

Figure 20A:
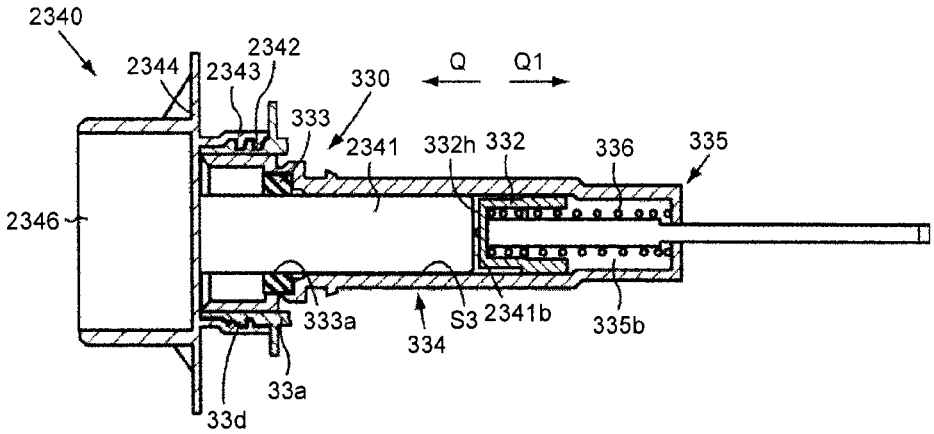
FIGS. 20A to 20C are top plan views of the cap in detachment operation.
Figure 20B:
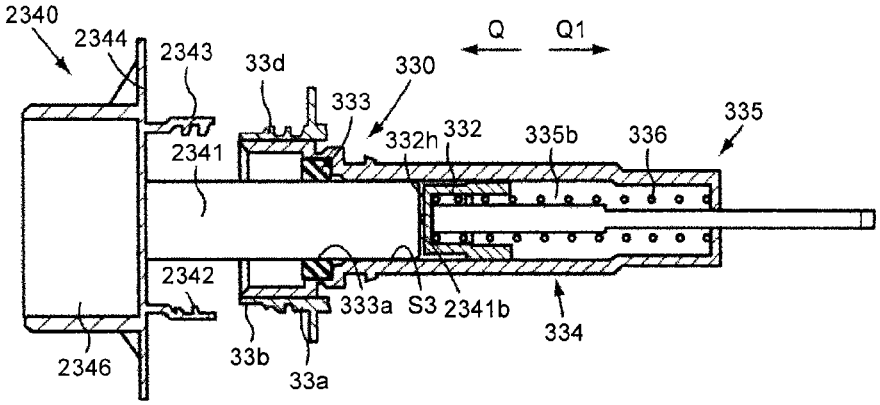

As illustrated in FIG. 20A, the container shutter 332 is biased toward the closing position by the container shutter spring 336. Therefore, if the cap 2340 is detached from the container opening 33*a* of the container body 33, the container shutter 332 moves to the closing position following the cap 2340 as illustrated in FIG. 20B. Therefore, because the toner T is not provided in the space (movement space) S3 in which the container shutter 332 moves, even when the toner container 32 is set in the toner replenishing device 60 as illustrated in FIG. 8, the toner T with the low fluidity is not compressed by the container shutter 332 and does not prevent the container shutter 332 from moving back to the closing position.

Figure 20C:
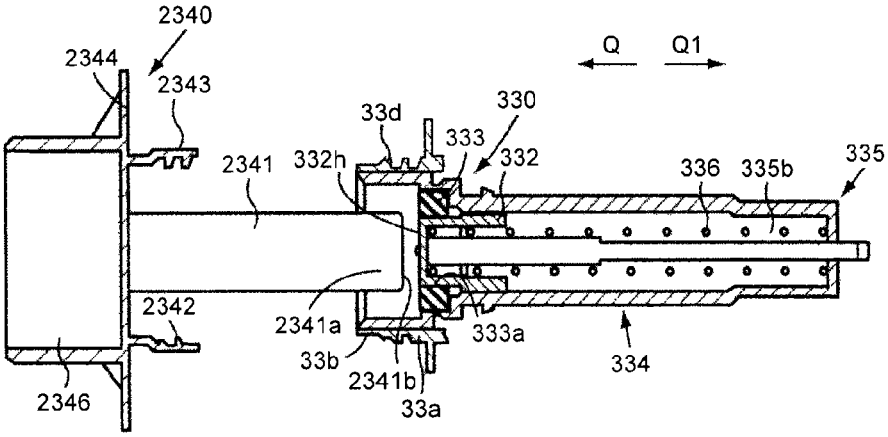

Even if the toner T flows into the movement space S3 of the container shutter 332 that has moved following the cap 2340 as illustrated in FIGS. 20A to 20C, when the toner container 32 is set in the toner replenishing device 60 and the container shutter 332 moves to the opening position again as illustrated in FIGS. 11A to 11D, the space S3 into which the toner T has flown is made. This provides an escape for the toner T and prevents the toner T from being compressed.

Figure 21A:
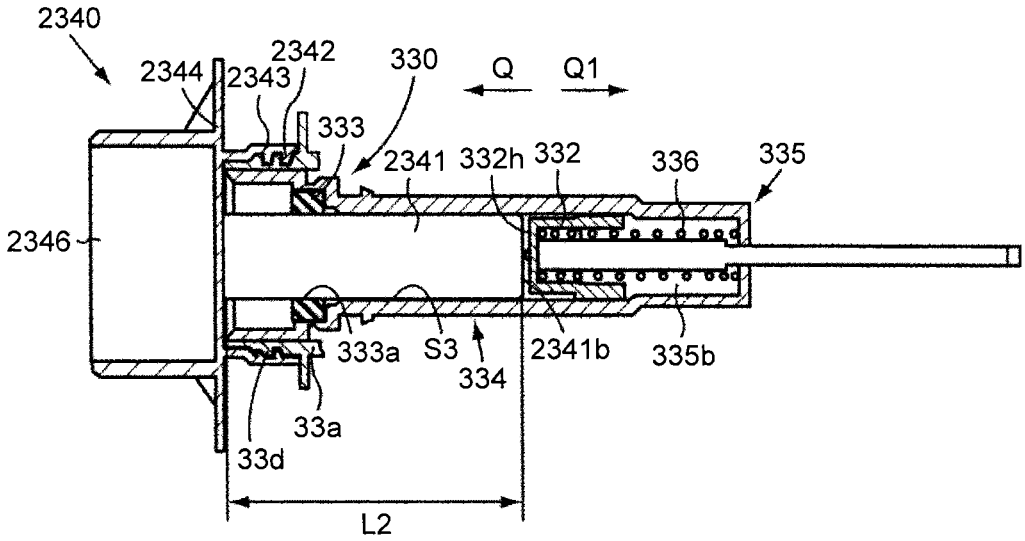
FIG. 21A is a diagram for explaining a relationship between the length of an insertion part and the length of a nozzle insertion opening.
Figure 21B:
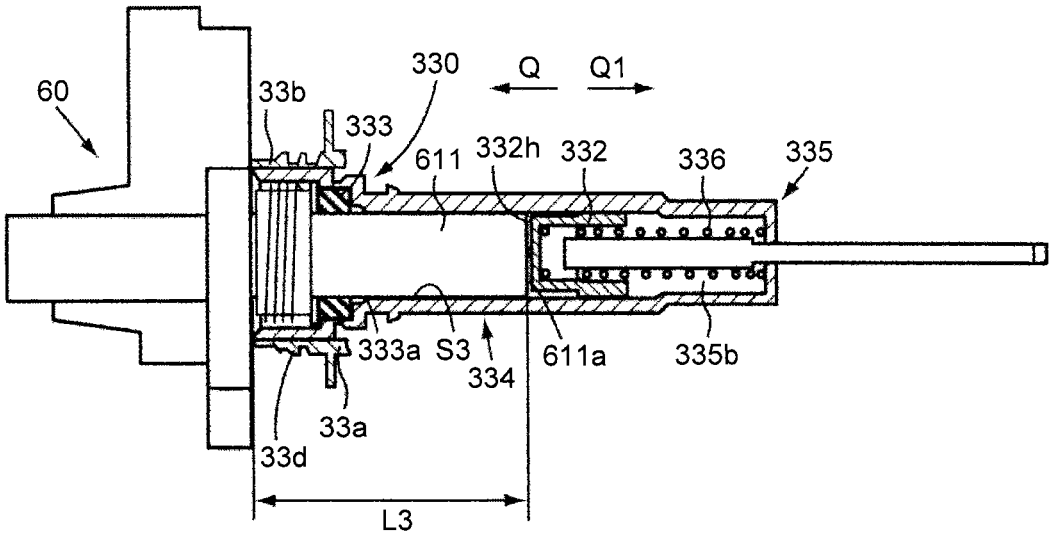
FIG. 21B is a diagram for explaining a relationship between the length of a conveying nozzle and the length of the nozzle insertion opening.

It is desirable that the length L2 of the insertion part 2341, which is an insertion distance of the insertion part 2341 in the nozzle receiver 330 as illustrated in FIG. 21A, be set to be longer than an insertion length L3 of the conveying nozzle 611 in the receiving opening 331, which is an insertion distance of the conveying nozzle 611 in the nozzle receiver 330 as illustrated in FIG. 21B. This is because, if the length (insertion distance) L2 of the insertion part 2341 is longer than the insertion length (insertion distance) L3 of the conveying nozzle 611, when the toner T flows into the movement space S3 in the container shutter 332 that has moved following the cap 2340, the space S3 as an escape for the toner T at the time of insertion of the conveying nozzle 611 can be increased by L2-L3, and the toner T is less likely to be compressed.

Figure 22:
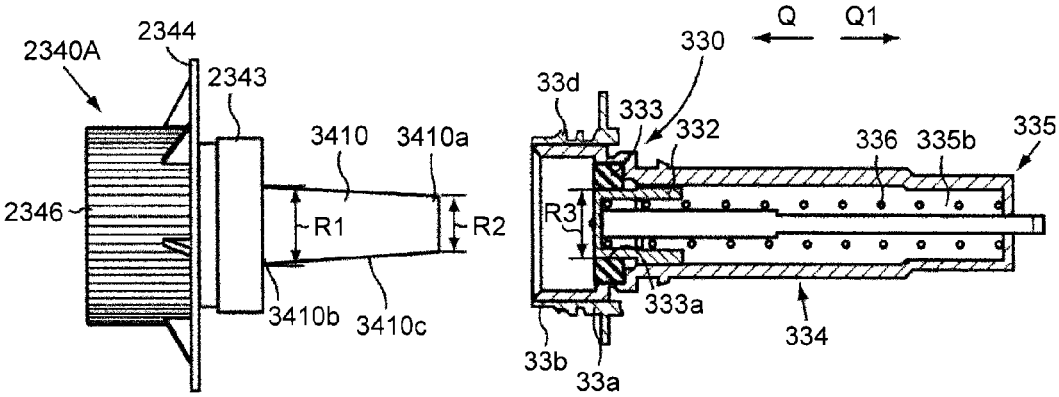
FIG. 22 is a cross-sectional view for explaining another example of the cap according to the second embodiment.

FIG. 22 illustrates a cap (outer cap) 2340A according to another example of the second embodiment. The cap 2340A is detachably attached to the outer surface 33*b* of the container opening 33*a*. The cap 2340A seals the receiving opening 331 and the container opening 33*a* when attached to the outer surface 33*b* of the container opening 33*a*. The cap 2340A includes an insertion part that is inserted in the receiving opening 331 and that has a different shape from that of the example as illustrated in FIG. 17 or the like.

An insertion part 3410 provided on the cap 2340A of this example has a conical trapezoid shape such that the diameter increases from an opening position side to a closing position side of the container shutter 332. An outer surface 3410*c* of the insertion part 3410 has a tapered shape such that the diameter increases from the opening position side to the closing position side of the container shutter 332. Specifically, a diameter R1 of a portion 3410*b* of the insertion part 3410 on the closing position side is greater than a diameter R2 of an end portion 3410*a* of the insertion part 3410 on the opening position side. The diameter R1 is also greater than a diameter R3 of a hole (through hole) 333*a* provided in the center of the ring-shaped container seal 333. The diameter R2 is smaller than the diameter R3.

The portion 3410*b* is a portion to be disposed inside the hole 333*a* of the container seal 333 when the insertion part 3410 is inserted in the receiving opening 331 and located at the attachment completed position.

With the insertion part 3410 in the shape as described above, even if variation of components or an assembly error occurs, the container seal 333 can be elastically deformed from the inside to the outside on the hole 333*a* side by the insertion part 3410 when the cap 2340A is located at the attachment completed position. Therefore, the insertion part 3410 and the container seal 333 can prevent a gap from being generated at the hole 333*a*, so that the sealing performance can be maintainer or improved. Further, because the diameter R2 is set to be smaller than the diameter R3, when the cap 2340A is attached to the outer surface 33*b* of the container opening 33*a* (the container body 33), the end portion 3410*a* can easily enter the hole 333*a* at the container seal 333 and the attachment performance can be improved. The shape of the insertion part 3410 is not limited to the conical trapezoid shape as long as it has a cross section in which the diameter increases from the opening position side to the closing position side. Therefore, a conical shape may be employed, for example.

Figure 23:
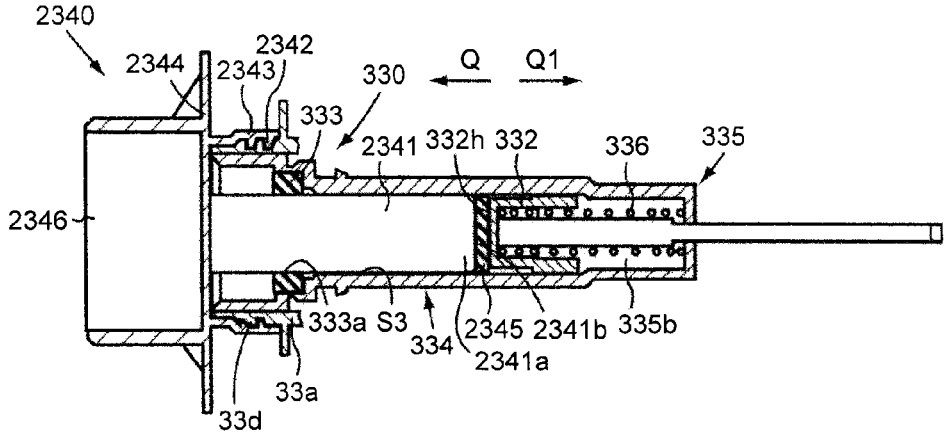
FIG. 23 is a cross-sectional view for explaining a still another example of the cap according to the second.

FIG. 23 illustrates still another example of the second embodiment. In this example, a seal 2345 is provided at the end portion 2341*a* of the insertion part 2341 located on the opening position side in the cap 2340. The seal 2345 may be made of an elastic material or a foamed material.

By providing the seal 2345 at the end portion 2341*a* of the insertion part 2341 that comes in contact with the end surface 332*h* of the container shutter 332, it is possible to fill even a small space between the end portion 2341*a* and the end surface 332*h*. Therefore, when the cap 2340 is detached from the outer surface 33*b* of the container opening 33*a* (the container body 33), toner accumulated in the small space between the end portion 2341*a* and the end surface 332*h* can be received or borne by the seal 2345. Consequently, it is possible to prevent the toner from being discharged to the outside of the toner container 32.

In particular, if a protrusion as illustrated in FIG. 19 is provided in order to reduce the contact area between the end surface 332*h* of the container shutter 332 and the end surface 611*a* of the conveying nozzle 611 to reduce frictional resistance, toner is likely to be accumulated in the small space. Even in this case, it is possible to receive or bear the accumulated toner by the seal 2345, and prevent the toner from being discharged to the outside of the toner container 32, which is preferable.

As described above, according to the second embodiment, the cap 2340 is provided with the insertion part 2341 that has the length L2 so as to fill the space (movement space) S3 of the moving region L1 of the container shutter 332 inside the container shutter supporter 334, and prevents the toner T from entering the space (movement space) S3 when the cap 2340 is located at the attachment completed position during transportation of the toner container 32 or the like. Therefore, when the container shutter 332 moves to the closing position upon detachment of the cap 2340, no toner T is present in the space (movement space) S3 in which the container shutter 332 moves. Specifically, when the toner container 32 is set in the toner replenishing device 60, almost no toner T enters the space (movement space) S3 in which the container shutter 332 moves. Therefore, the toner T is not compressed upon movement of the container shutter 332 from the closing position to the opening position. Further, when the container shutter 332 moves back to the closing position, the movement is not disturbed by the compressed toner T. Therefore, it is possible to prevent the toner container 32 from being detached while the receiving opening 331 remains open, enabling to prevent toner leakage.

According to an embodiment of the present invention, the inner cap is provided that covers the sealing portion and the supporter of the opening/closing member at least when the opening/closing member is located at the closing position. Therefore, it is possible to prevent the toner from entering an opening/closing region of the opening/closing member. Consequently, it is possible to prevent a situation in which the opening/closing member is prevented from moving to the closing position by the toner.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A nozzle receiver for use with a powder container, the nozzle receiver comprising:

a shutter to open an opening of the nozzle receiver to an opening position when the shutter is pressed by a conveying nozzle of an image forming apparatus, and to close the opening to a closing position when not being pressed by the conveying nozzle, and that includes a sealing portion for sealing the opening;

a supporter to support the shutter between the opening position and the closing position; and a movable cap to cover the supporter at a covering position when the shutter is at the closing position, and to expose the supporter at an exposing position when the shutter is at the opening position, the movable cap being movable between the covering position and the exposing position in correspondence to the shutter being in the closing position and the opening position.

2. The nozzle receiver according to claim 1, wherein the movable cap moves with the shutter relative to the supporter.

3. The nozzle receiver according to claim 2, wherein the movable cap includes an inner end surface that comes in contact with a part of the shutter when the shutter moves to the opening position.

4. The nozzle receiver according to claim 1, wherein the supporter supports the shutter between the opening position and the closing position in a longitudinal direction thereof, and the movable cap covers the supporter along the longitudinal direction when the shutter is at the closing position.

5. The nozzle receiver according to claim 4, wherein the movable cap includes an inner side protrusion that protrudes from an inner surface of the movable cap to an outer surface of the supporter housed in the movable cap, and the supporter includes a stopper that protrudes from the outer surface of the supporter to the inner surface of the movable cap.

6. The nozzle receiver according to claim 4, wherein the supporter includes an engaging groove that holds the movable cap when the movable cap is located at a closure position at which the movable cap longitudinally covers the supporter.

7. The nozzle receiver according to claim 4, wherein the movable cap includes a seal that seals a gap between the supporter and an inner surface of the movable cap when the movable cap is located at a closure position at which the movable cap longitudinally covers the supporter.

8. The nozzle receiver according to claim 4, wherein the movable cap is in a form of a protrusion such that the movable cap protrudes from an end portion located distant from the sealing portion of the shutter in the longitudinal direction when the shutter is located at the closing position, and such that a projection area is reduced from an upstream side to a downstream side in a moving direction in which the shutter moves from the closing position to the opening position.

9. The nozzle receiver according to claim 1, further comprising a spring that is provided at the supporter and that biases the shutter to the closing position.

10. A powder container comprising the nozzle receiver according to claim 1.

11. The powder container according to claim 10, wherein the powder is toner.

12. The powder container according to claim 10, wherein the powder includes toner and carrier particles.

13. An image forming apparatus comprising:

the powder container according to claim 10; and the conveying nozzle that is inserted in the opening of the supporter along with attachment operation of the powder container and that receives the powder supplied from the powder container.

14. A powder container comprising:

a powder storage to store therein powder to be supplied to an image forming apparatus;

a rotary conveyor within the powder container which conveys powder within the powder storage;

a nozzle receiver attached to the powder storage, the nozzle receiver including, a shutter to open an opening of the nozzle receiver to an opening position when the shutter is pressed by a conveying nozzle of an image forming apparatus, and to close the opening to a closing position when not being pressed by the conveying nozzle, and that includes a sealing portion for sealing the opening, and a supporter to support the shutter between the opening position and the closing position in a longitudinal direction thereof; and an outer cap attached to the powder storage which covers the nozzle receiver from outside of the powder container, and which includes an insertion part that is inserted in the supporter, wherein the insertion part fills a space of the supporter which is a moving region of the shutter.

15. The powder container according to claim 14, wherein the insertion part includes a conical shape or a conical trapezoid shape such that a diameter thereof is increased along the longitudinal direction of the supporter.

16. The powder container according to claim 14, wherein a length of the insertion part in the longitudinal direction is longer than a length of a part of the conveying nozzle in the supporter.

17. The powder container according to claim 14, wherein the outer cap includes a seal on an end portion of the insertion part on an opening position side.

18. The powder container according to claim 14, wherein the powder is toner.

19. The powder container according to claim 14, wherein the powder includes toner and carrier particles.

20. An image forming apparatus comprising:

the powder container according to claim 14; and the conveying nozzle that is inserted in the opening of the supporter along with attachment operation of the powder container and that receives the powder supplied from the powder container.

* * * * *